US008061286B2

(12) United States Patent
Hirata et al.

(10) Patent No.: US 8,061,286 B2
(45) Date of Patent: Nov. 22, 2011

(54) SEWING MACHINE AND COMPUTER-READABLE MEDIUM STORING SEWING MACHINE CONTROL PROGRAM

(75) Inventors: Takashi Hirata, Nagoya (JP); Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 328 days.

(21) Appl. No.: 12/320,334

(22) Filed: Jan. 23, 2009

(65) Prior Publication Data

US 2009/0188413 A1 Jul. 30, 2009

(30) Foreign Application Priority Data

Jan. 24, 2008 (JP) ..... 2008-013443

(51) Int. Cl.
*D05B 19/00* (2006.01)

(52) U.S. Cl. ..... 112/470.01; 112/102.5; 112/475.02

(58) Field of Classification Search ..... 112/102.5, 112/103, 470.01, 470.03, 470.04, 470.06, 112/475.02; 700/136–138
See application file for complete search history.

(56) References Cited

U.S. PATENT DOCUMENTS

| | | | | |
|---|---|---|---|---|
| 4,998,489 | A | 3/1991 | Hisatake et al. | |
| 5,323,722 | A * | 6/1994 | Goto et al. | 112/102.5 |
| 5,553,559 | A * | 9/1996 | Inoue et al. | 112/102.5 |
| 5,855,176 | A * | 1/1999 | Takenoya et al. | 112/102.5 |
| 5,865,133 | A | 2/1999 | Herbach et al. | |
| 5,911,182 | A | 6/1999 | Uyama et al. | |
| 6,000,350 | A * | 12/1999 | Koike et al. | 112/102.5 |
| 6,158,366 | A * | 12/2000 | Codos | 112/475.02 |
| 6,167,822 | B1 * | 1/2001 | Miyasako et al. | 112/102.5 |
| 7,155,302 | B2 | 12/2006 | Muto et al. | |
| 7,702,415 | B2 * | 4/2010 | Roos | 700/138 |
| 2006/0096510 | A1 | 5/2006 | Kuki et al. | |

FOREIGN PATENT DOCUMENTS

| | | |
|---|---|---|
| JP | A 02-057288 | 2/1990 |
| JP | A 06-346357 | 12/1994 |
| JP | A 08-041773 | 2/1996 |
| JP | A 2005-185297 | 7/2005 |
| JP | A 2005-279008 | 10/2005 |
| JP | A 2006-130124 | 5/2006 |
| JP | B2 3932625 | 3/2007 |

* cited by examiner

*Primary Examiner* — Nathan Durham
(74) *Attorney, Agent, or Firm* — Oliff & Berridge, PLC

(57) ABSTRACT

A sewing machine that is capable of sewing an embroidery pattern on a work cloth includes a storage device that stores embroidery data to identify a shape of the embroidery pattern and reference line data to identify a pattern position and a pattern angle. The sewing machine also includes an imaging device that captures an image of the work cloth onto which a marker is affixed, and a detection device that detects a marker position and a marker angle based on information of the image captured by the imaging device. The sewing machine further includes a conversion device that converts the embroidery data based on the pattern position, the pattern angle, the marker position, and the marker angle. The sewing machine further includes a sewing control device that controls sewing of the embroidery pattern based on the embroidery data obtained after conversion.

7 Claims, 16 Drawing Sheets

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2008-013443, filed Jan. 24, 2008, the disclosure of which is hereby incorporated herein by reference in its entirety.

BACKGROUND

The present disclosure relates to a sewing machine and a computer-readable medium storing a program that controls the sewing machine. More particularly, the present disclosure relates to a sewing machine that can easily determine a sewing position and a sewing angle of an embroidery pattern to sew the pattern, and a computer-readable medium storing a program that controls the sewing machine.

Conventionally, when sewing an embroidery pattern selected by a user to a predetermined position on a work cloth with a sewing machine capable of embroidery sewing, the user may have to operate an eight-directional key to thereby move an embroidery frame holding the work cloth to adjust a needle drop point coincides with the predetermined position. Also, when the user desires to change a sewing angle at which the embroidery pattern is to be sewn on the work cloth, the user may have to operate a rotation key to thereby rotate a preset angle for the embroidery pattern.

In contrast, a sewing machine disclosed in U.S. Pat. No. 5,911,182, for example, reads a sewing designation mark drawn beforehand on a work cloth that is attached to an embroidery frame, obtains at least one of a position and a direction for sewing an embroidery pattern on the work cloth on the basis of image data of the sewing designation mark, and edit embroidery data of the embroidery pattern in accordance with at least one of the obtained position and direction. In the case of position adjustment to the sewing designation mark, the center point of an outline of the embroidery pattern is used. In the case of direction adjustment to the sewing specification mark, a direction of the embroidery pattern is used. After the pattern data is edited, the sewing machine sews embroidery based on the post-edit pattern data.

SUMMARY

Various exemplary embodiments of the general principles described herein provide a sewing machine that can appropriately and easily determine a sewing position and a sewing angle of an embroidery pattern on a work cloth and sew the embroidery pattern, and a computer-readable medium storing a program that controls the sewing machine.

Exemplary embodiments provide a sewing machine that is capable of sewing an embroidery pattern on a work cloth held by an embroidery frame. The sewing machine includes a storage device that stores embroidery data to identify a shape of the embroidery pattern and reference line data to identify a pattern position and a pattern angle. The pattern position is a position on the work cloth at which the embroidery pattern is to be sewn, and the pattern angle is an angle with respect to a predetermined direction on the work cloth at which the embroidery pattern is to be sewn. The sewing machine also includes an imaging device that captures an image of the work cloth onto which a marker that can be affixed onto the work cloth is affixed, and a detection device that detects a marker position and a marker angle based on information of the image captured by the imaging device. The marker position is a position at which the marker is affixed onto the work cloth, and the marker angle is an angle with respect to the predetermined direction on the work cloth at which the marker is affixed. The sewing machine further includes a conversion device that converts the embroidery data based on the pattern position and the pattern angle contained in the reference line data, and the marker position and the marker angle detected by the detection device. The sewing machine still further includes a sewing control device that controls sewing of the embroidery pattern based on the embroidery data obtained after conversion by the conversion device.

Exemplary embodiments also provide a computer-readable medium storing a program to control a sewing machine that is capable of sewing an embroidery pattern on a work cloth held by an embroidery frame. The program causes a controller of the sewing machine to execute the following instructions. Acquiring information of an image, captured by an imaging device, of the work cloth onto which a marker that can be affixed onto the work cloth is affixed, detecting a marker position and a marker angle based on the information of the captured image, converting predefined embroidery data to identify a predefined shape of the embroidery pattern based on a pattern position and a pattern angle contained in predefined reference line data to identify the pattern position and the pattern angle, and controlling sewing of the embroidery pattern based on the embroidery data obtained after conversion. The marker position is a position at which the marker is affixed onto the work cloth, and the marker angle is an angle with respect to a predetermined direction on the work cloth at which the marker is affixed. The pattern position is a position on the work cloth at which the embroidery pattern is to be sewn, and the pattern angle is an angle with respect to the predetermined direction on the work cloth at which the embroidery pattern is to be sewn.

BRIEF DESCRIPTION OF THE DRAWINGS

Exemplary embodiments will be described below in detail with reference to the accompanying drawing in which.

DETAILED DESCRIPTION

The following will describe embodiments with reference to the drawings. First, the configuration of a sewing machine 1 will be described below with reference to FIGS. 1 and 2. In the following description, the side of the page of FIG. 1 toward the user is referred to as the front side of the sewing machine 1, the side away from the user is referred to as the rear side, and the right-and-left direction of the paper is referred to as the right-and-left direction of the sewing machine 1.

Figure 1:
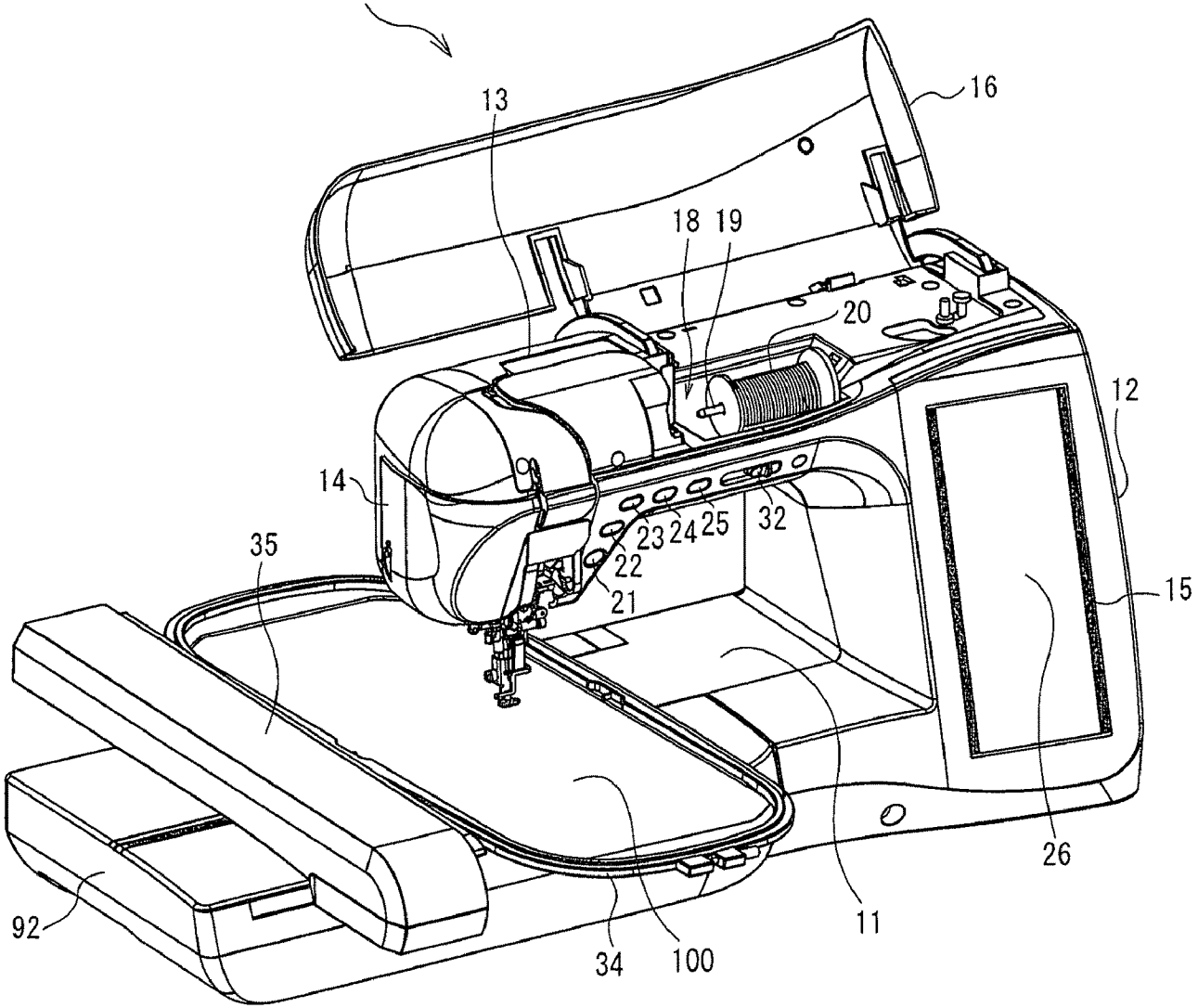
FIG. 1 is a perspective view of a sewing machine equipped with an embroidery frame.

As shown in FIG. 1, the sewing machine 1 has a sewing machine bed 11 extending in the right-and-left direction, a pillar 12 erected upward at the right end of the sewing machine bed 11, an arm 13 extending leftward from the upper end of the pillar 12, and a head 14 provided at the left end of the arm 13. The sewing machine bed 11 is equipped with a needle plate (not shown) on an upper surface. The sewing machine bed 11 contains a feed dog (not shown) that transfers a work cloth to be sewn by a predetermined feed amount, a cloth feed mechanism (not shown) that drives the feed dog, a feed adjustment pulse motor 78 (see FIG. 3) that adjusts the feed amount, and a shuttle mechanism (not shown) below the needle plate.

Above the sewing machine bed 11, an embroidery frame 34 to hold a work cloth 100 is disposed. A region inside the embroidery frame 34 makes an embroidery region in which stitches of an embroidery pattern can be formed. An embroidery frame transfer unit 92 that transfers the embroidery frame 34 can be attached to and detached from the sewing machine bed 11. Over the embroidery frame transfer unit 92, a carriage cover 35 extends in the front-and-rear direction. The carriage cover 35 contains a Y-axis transfer mechanism (not shown) that transfers a carriage (not shown) in the Y-direction (front-and-rear direction). The embroidery frame 34 can be attached to and detached from the carriage. To the right of the carriage, a frame attachment portion (not shown) is provided, to which the embroidery frame 34 may be attached. The frame attachment portion protrudes more rightward than the right side surface of the carriage cover 35. An attachment portion 93 (see FIG. 11) provided on the left side of the embroidery frame 34 may be attached to the frame attachment portion. The carriage, the Y-axis transfer mechanism, and the carriage cover 35 may be transferred in the X-direction (right-and-left direction) by an X-axis transfer mechanism provided within the body of the embroidery frame transfer unit 92. In such a manner, the embroidery frame 34 may be transferred in the X-direction. The X-axis transfer mechanism and the Y-axis transfer mechanism are respectively driven by an X-axis motor 83 (see FIG. 3) and a Y-axis motor 84 (see FIG. 3). By driving a needle bar 6 (see FIG. 2) and the shuttle mechanism (not shown) while transferring the embroidery frame 34 in the X and Y directions, pattern formation operations to form predetermined stitches or a predetermined pattern such as an embroidery pattern on the work cloth 100, may be performed. Further, in the case of sewing an ordinary pattern, instead of an embroidery pattern, the embroidery frame transfer unit 92 may be detached from the sewing machine bed 11 and ordinary sewing may be performed while the work cloth is fed by the feed dog.

The pillar 12 has a vertically long rectangular liquid crystal display (hereinafter referred to as LCD) 15 on its front surface. The LCD 15 may display names and illustrations of commands to execute various kinds of commands required to set or edit a variety of patterns and control sewing operations. The LCD 15 also displays various set values and messages relating to sewing.

The LCD 15 is equipped with a touch panel 26 corresponding to various display positions where names of a plurality of patterns, function names for executing various functions, set numerical values on various setting screens, etc. are displayed. By pressing a position on the touch panel 26 that corresponds to a pattern display portion or a setting portion on the screen displayed on the LCD 15 with a finger or a dedicated touch pen, the user can select a pattern to be sewn, instruct a function, set a numerical value, etc. An operation of pressing the touch panel 26 is hereinafter referred to as a "panel operation".

Next, a configuration of the arm 13 will be described below. The arm 13 is provided with a cover 16 to be opened and closed over an upper portion of the arm 13. The cover 16 is provided along the longitudinal direction of the arm 13 and axially supported on the upper rear part of the arm 13 so that the cover 16 can be opened and closed around the right-and-left directional axis. Under the cover 16, a concaved spool housing 18 is formed in the vicinity of the midsection of the upper portion of the arm 13. The spool housing 18 houses a thread spool 20 from which a needle thread is supplied to the sewing machine 1. From the inner wall surface of the thread spool housing 18 on the pillar 12 side, a spool pin 19 protrudes toward the head 14. The thread spool 20 may be attached to the spool pin 19 when the spool pin 19 is inserted through an insertion hole (not shown) formed in the thread spool 20. A needle thread (not shown) extending from the thread spool 20 may pass through a tensioner and a thread take-up spring, which are disposed on the head 14 to adjust thread tension, and thread hooking portions, such as a thread take-up lever etc. for taking up the needle thread by reciprocating in the up-and-down direction. Then, the needle thread may be supplied to a sewing needle 7 (see FIG. 2) attached to the needle bar 6. The needle bar 6 is driven to move up and down by a needle bar up-and-down movement mechanism (not shown) provided in the head 14. The needle bar up-and-down movement mechanism is driven by a drive shaft (not shown), which is rotationally-driven by a sewing machine motor 79 (see FIG. 3).

At the lower portion of the front surface of the arm 13, a sewing start-and-stop switch 21, a reverse stitch switch 22, a needle up-and-down switch 23, a presser foot elevation switch 24, an automatic threading switch 25, are provided. The sewing start-and-stop switch 21 starts and stops operations of the sewing machine 1, that is, may be used to instruct starting and stopping of sewing. The reverse stitch switch 22 may be used to input an instruction of feeding the work cloth from the rear side to the front side, which is opposite to the normal feed direction. The needle up-and-down switch 23 may be used to input an instruction of switching the position of the needle bar 6 (see FIG. 2) between an upper position and a lower position. The presser foot elevation switch 24 may be used to instruct raising and lowering a presser foot 47 (see FIG. 2). The automatic threading switch 25 may be used to instruct starting of automatic threading, that is, leading the needle thread through the thread take-up lever, the tensioner, and the thread take-up spring and finally threading the sewing needle 7 (see FIG. 2). A speed controller 32 is provided at the midsection of the lower portion of the front surface of the arm 13. The speed controller 32 may be used to adjust a speed at which the needle bar 6 is driven up and down (see FIG. 2), that is, a rotary speed of the drive shaft.

Figure 2:
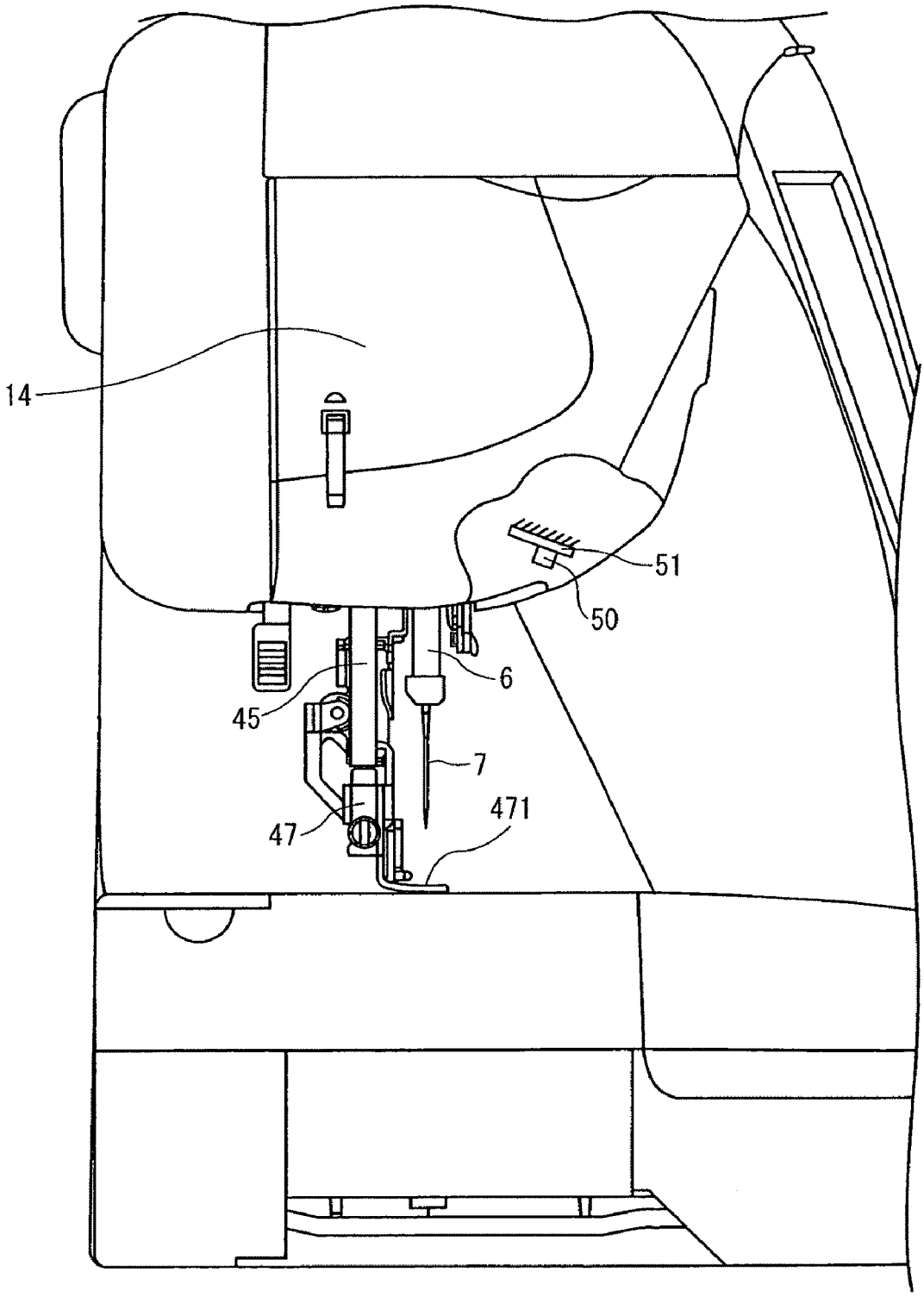
FIG. 2 is a left side view of major components of the sewing machine in a condition where a head thereof is partially cut.

Next, the needle bar 6, the sewing needle 7, a presser bar 45, a presser foot 47, and a neighboring area will be described below with reference to FIG. 2. As shown in FIG. 2, the needle bar 6 and the presser bar 45 are provided below the head 14. The sewing needle 7 is attached to the lower end of the needle bar 6. The presser foot 47 to hold down the work cloth is fixed to the lower end of the presser bar 45. A lower end portion 471 of the presser foot 47 is made of transparent resin, for example, so that an image of the work cloth or stitches below the presser foot 47 can be captured. Further, an image sensor 50 is mounted in such a manner that the image sensor 50 can capture an image of a needle drop point of the sewing needle 7 and a neighboring area of the needle drop point. The needle drop point refers to a point on a work cloth at which the sewing needle 7 is affixed to and through the work cloth when moved downward by the needle bar up-and-down movement mechanism. The image sensor 50 may include a CMOS (Complementary Metal Oxide Semiconductor) sensor and a control circuit. An image can be captured by the CMOS sensor. In the present embodiment, as shown in FIG. 2, a support frame 51 is attached to the frame (not shown) of the sewing machine 1 inside the head 14, and the image sensor 50 is fixed to the support frame 51. By employing an inexpensive CMOS sensor in the image sensor 50, costs of the image sensor 50 may be reduced.

Figure 3:
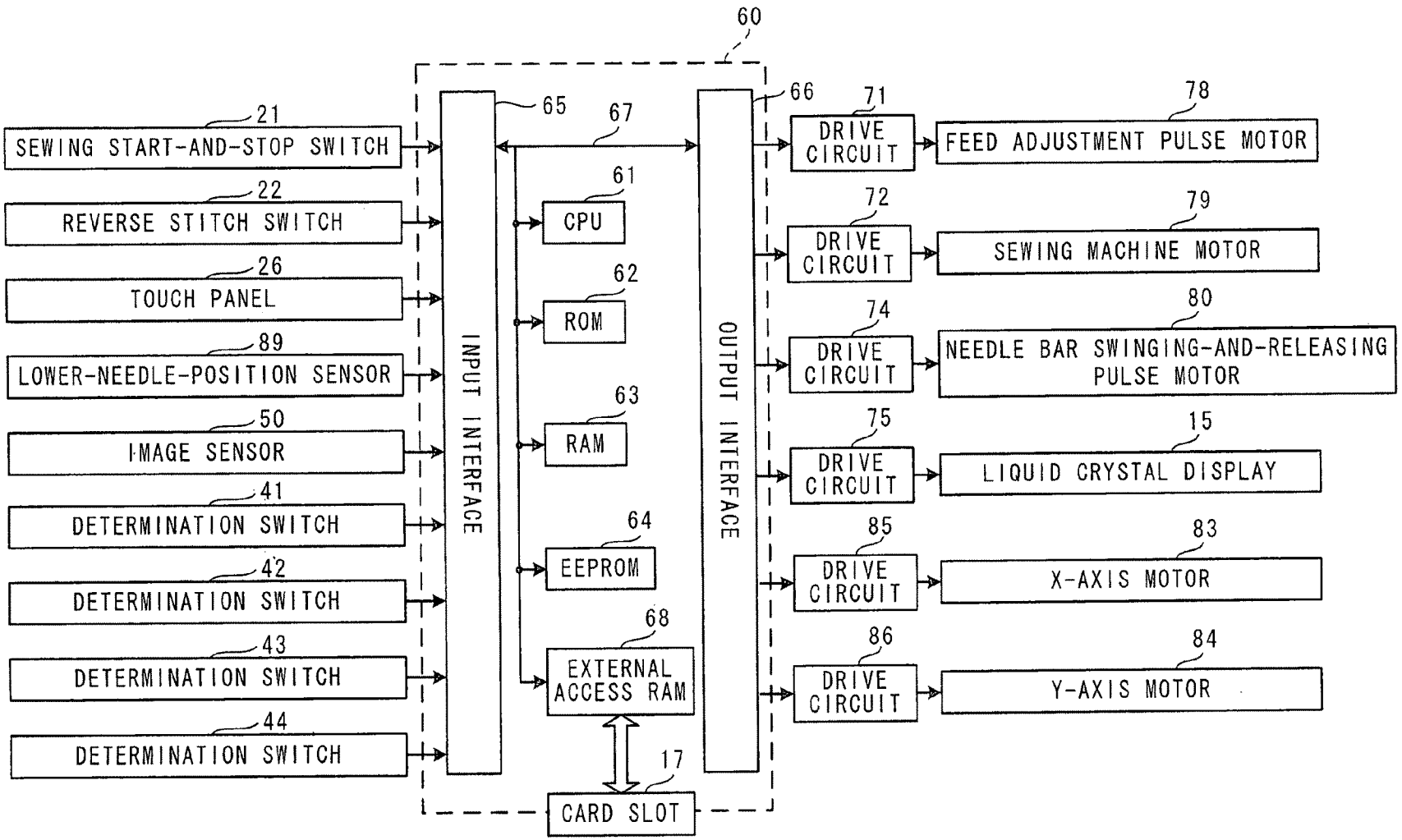
FIG. 3 is a block diagram of an electrical configuration of the sewing machine.

Next, the electrical configuration of the sewing machine 1 will be described below with reference to FIG. 3. As shown in FIG. 3, the sewing machine 1 includes a CPU 61, a ROM 62, a RAM 63, an EEPROM 64, a card slot 17, an external access RAM 68, an input interface 65, an output interface 66, etc., which are connected with each other via a bus 67. The sewing start-and-stop switch 21, the reverse stitch switch 22, the touch panel 26, a lower-needle-position sensor 89, the image sensor 50, and determination switches 41, 42, 43, and 44 that determine the type of an embroidery frame are connected to the input interface 65. The above-described needle up-and-down switch 23, the presser foot elevation switch 24, the automatic threading switch 25, and the speed controller 32 are not shown in the drawing. The determination switches 41, 42, 43, and 44 will be described in detail later. Drive circuits 71, 72, 74, 75, 85, and 86 are electrically connected to the output interface 66. The drive circuit 71 drives the feed adjustment pulse motor 78. The drive circuit 72 drives the sewing machine motor 79. The drive circuit 74 drives a needle bar swinging-and-releasing pulse motor 80 that makes the needle bar 6 to swing and that operates to release the needle bar 6. The drive circuit 75 drives the LCD 15. The drive circuits 85 and 86 respectively drive the X-axis motor 83 and the Y-axis motor 84 to transfer the embroidery frame 34.

The CPU 61 conducts main control over the sewing machine 1 and executes various kinds of computation and processing in accordance with a control program stored in a program data storage area 201 of the ROM 62, which is a read-only memory. The RAM 63, which is a random access memory, has a variety of storage areas as required for storing the results of computation and processing carried out by the CPU 61. The sewing start-and-stop switch 21 is a button-type switch. The lower-needle-position sensor 89 detects a rotation phase of the drive shaft. The lower-needle-position sensor 89 is set up to output an ON signal, if, as the drive shaft rotates, the needle bar 6 lowers from the upper needle position to permit the tip of the sewing needle 7 to reach a position lower than the upper surface of the needle plate (not shown).

Figure 4:
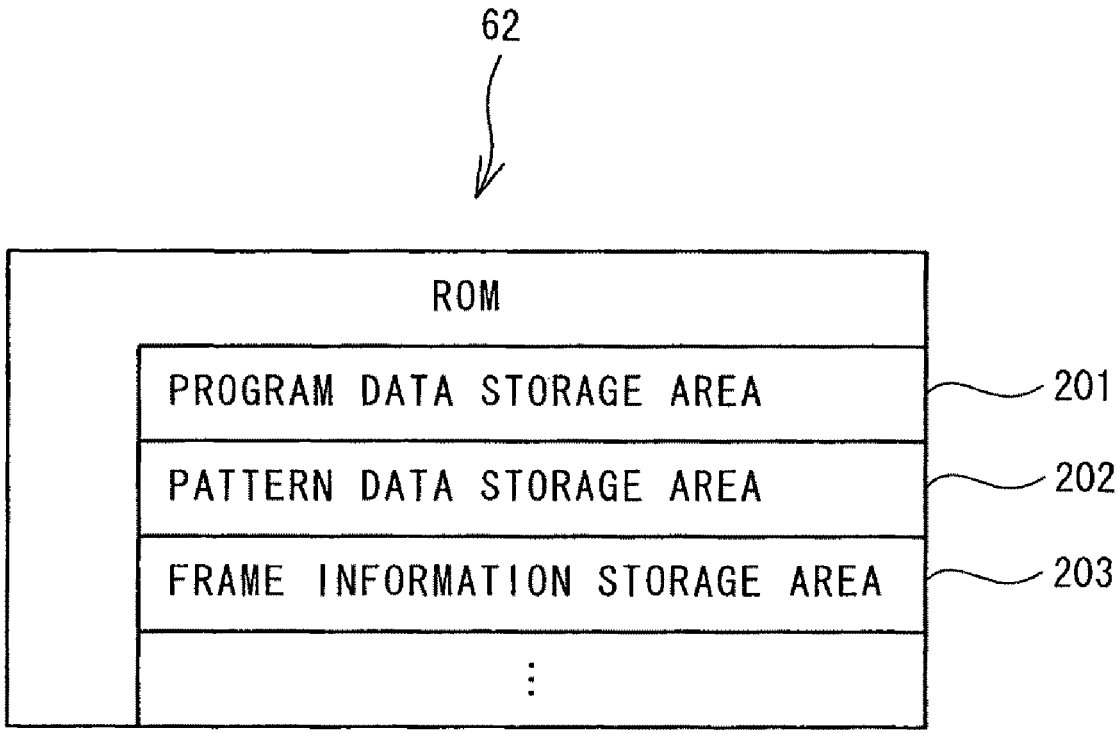
FIG. 4 is a schematic diagram of storage areas arranged in a ROM.

Next, the storage areas arranged in the ROM 62 will be described below with reference to FIG. 4. As shown in FIG. 4, the ROM 62 includes a program data storage area 201, a pattern data storage area 202, a frame information storage area 203, and other storage areas.

The program data storage area 201 stores program data required by the CPU 61 to execute processing of recognizing a marker 120 (see FIG. 6), sewing an embroidery pattern, etc. The pattern data storage area 202 stores a plurality of pieces of pattern data 146 (see FIG. 6) for various embroidery patterns 140 (see FIG. 7). The pattern data 146 is used to sew the embroidery pattern 140 on the work cloth 100 (see FIG. 1). The pattern data 146, which will be described later in detail, is data to determine a shape, a sewing position, a sewing angle, etc. of the embroidery pattern 140. When executing sewing operations, from among these pieces of pattern data 146, a piece of the pattern data 146 corresponding to the embroidery pattern 140 selected by the user may be read and used. The frame information storage area 203 stores a plurality of pieces of frame information, which is information about sizes, shapes, etc. of the embroidery frame 34 (see FIG. 1) holding the work cloth 100 and other various types of embroidery frames (not shown). As described in detail later, the frame information may be read and used to determine whether the embroidery pattern 140 fits within a sewing area (embroidery sewing-enabled region) of the embroidery frame attached to the carriage, in a case where a position of the embroidery pattern 140 to be sewn on the work cloth 100 has been set (see S23 in FIG. 8). The sewing area of the embroidery frame may be set beforehand in accordance with the size and the shape of the embroidery frame.

Figure 5:
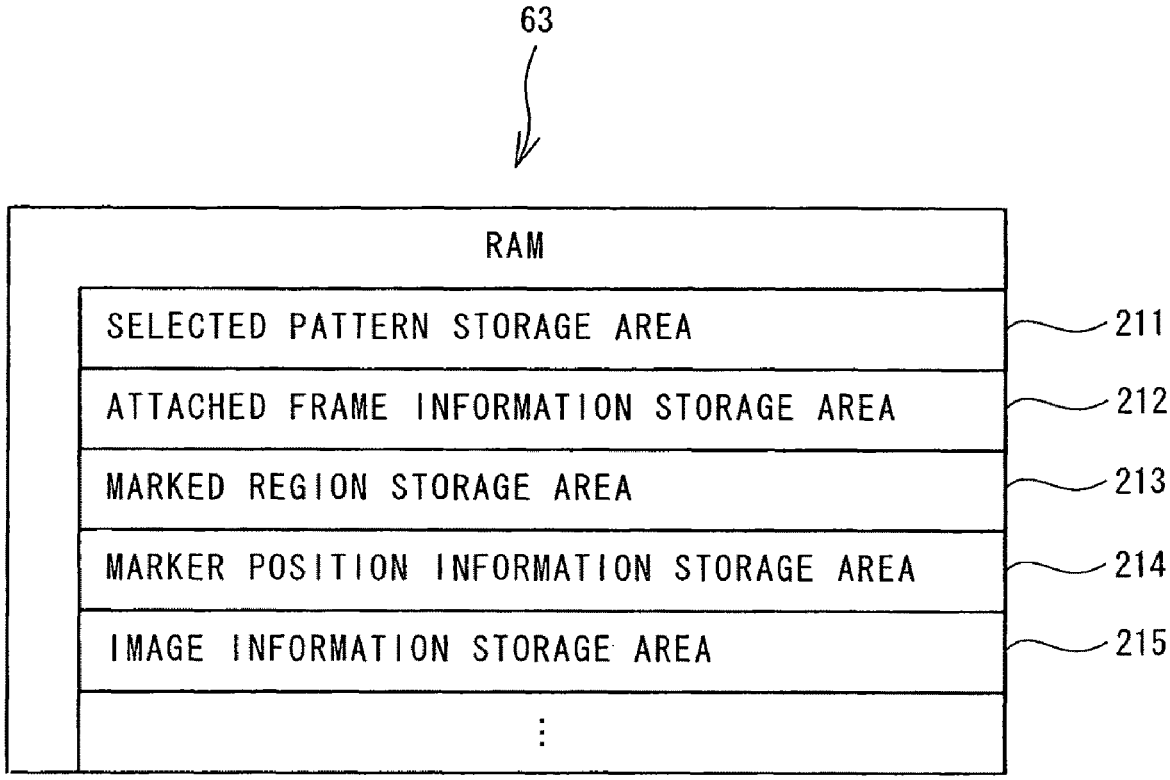
FIG. 5 is a schematic diagram of storage areas arranged in a RAM.

Next, the storage areas arranged in the RAM 63 will be described below with reference to FIG. 5. As shown in FIG. 5, the RAM 63 has a selected pattern storage area 211, an attached frame information storage area 212, a marked region storage area 213, a marker position information storage area 214, an image information storage area 215, and other storage areas.

The selected pattern storage area 211 stores the pattern data of the embroidery pattern 140 selected by the user through panel operations. The pattern data may be read from among the pattern data pieces stored in the pattern data storage area 202 (see FIG. 4) of the ROM 62. When a sewing position and a sewing angle of the embroidery pattern 140 are specified and processing of converting the pattern data (see S21 in FIG. 8) is executed, the pattern data 146 stored in the selected pattern storage area 211 is used. The attached frame information storage area 212 stores the frame information that corresponds to the embroidery frame 34 attached to the carriage. The frame information may be read from among the frame information pieces stored in the frame information storage area 203 (see FIG. 4) of the ROM 62. The marked region storage area 213 stores information of a region in which the marker 120 is affixed on the work cloth 100. The region in which the marker 120 is affixed on the work cloth 100 is hereinafter referred to as a "marked region". The marked region may be set by the user in a case where image of the marker 120 is captured by the image sensor 50 (see FIG. 2). As described in detail later, if the image sensor 50 is used in image capturing, the processing to recognize the marker 120 is performed by preferentially using the information of the marked region stored in the marked region storage area 213 (see S63 in FIG. 14). Further, the marker position information storage area 214 stores the information of a marked position and a marked angle by the marker 120. The marked position and marked angle may be identified by capturing an image of the marker 120. Based on the identified marked position and marked angle by the marker 120, the embroidery pattern 140, of which the pattern data is stored in the selected pattern storage area 211, may be sewn. The image information storage area 215 stores image information obtained as a result of image capturing by the image sensor 50. By performing image processing on the image information, processing to recognize the marker 120 (see S67 in FIG. 14) may be executed.

Figure 6:
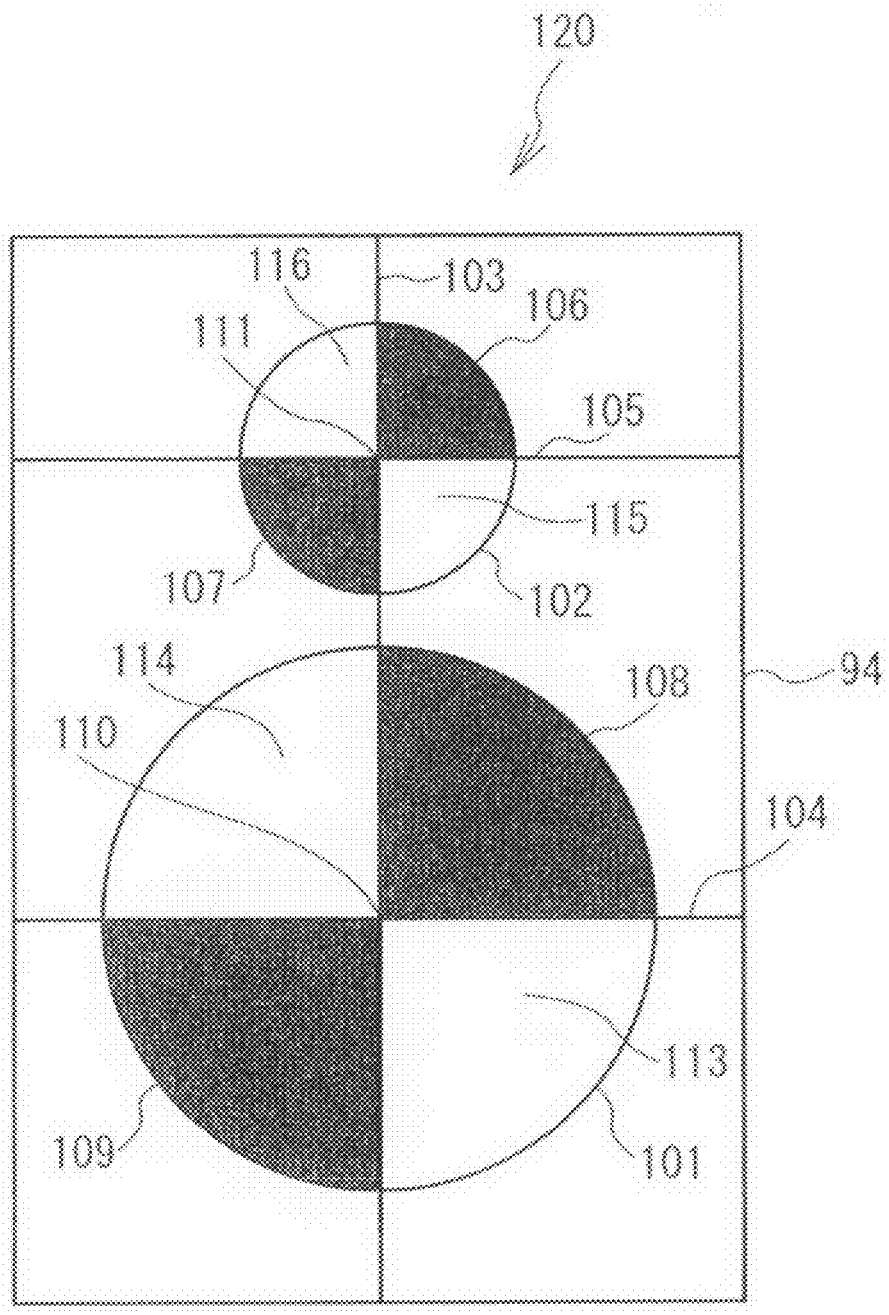
FIG. 6 is an illustration of a shape of a marker.

Next, an example of the marker 120 to be affixed onto the work cloth 100 (see FIG. 1) will be described below with reference to FIG. 6. The marker 120 shown in FIG. 6 is made of a transparent laminar base material sheet 94. The base material sheet 94 is rectangle-shaped and measures, for example, about three centimeters in length and about two centimeters in width. The size and the shape of the base material sheet 94, however, are not limited to the above-mentioned example. The base material sheet 94 has a first circle 101 and a second circle 102 drawn on its upper surface. The second circle 102 is disposed above the first circle 101 and has a smaller diameter than the first circle 101. The base material sheet 94 has three line segments 103, 104, and 105. The linear line segment 103 extends through a center 110 of the first circle 101 and a center 111 of the second circle 102 in the vertical (longitudinal) direction. The line segment 104 orthogonally intersects with the line segment 103 at the center 110 of the first circle 101. The line segment 105 orthogonally intersects with the line segment 103 at the center 111 of the second circle 102. These line segments 103, 104, and 104 are drawn all the way to the outer edges of the base material sheet 94, respectively.

Among four portions enclosed and divided by a circumference of the first circle 101, the line segment 103, and the line segment 104, the upper right portion 108 and the lower left portion 109 are filled with black, while the lower right portion 113 and the upper left portion 114 are filled with white. Among four portions enclosed and divided by a circumference of the second circle 102, the line segment 103, and the line segment 105, the upper right portion 106 and the lower left portion 107 are filled with black, while the lower right portion 115 and the upper left portion 116 are filled with white. The remaining portions of the base material sheet 94 other than the above are transparent. The colors with which to fill the divided portions are not limited to black and white, but may be a combination of any other colors as far as the contrast is clear. Further, for example, if the work cloth 100 is a fabric colored white or nearly white, a marker having divided portions only filled with black may be employed. Conversely, if the work cloth 100 is a fabric colored black or nearly black, a marker having divided portions only filled with white may be employed. In such a manner, a marker with an appropriate color(s) may be employed, corresponding to the color of the work cloth 100.

Over the back surface of the base material sheet 94, a transparent adhesive is applied. Therefore, the base material sheet 94 can be affixed onto the work cloth 100. The base material sheet 94 may usually be attached to release paper (not shown). The user may peel off the base material sheet 94 from the release paper for use.

In the present embodiment, before sewing the embroidery pattern 140 (see FIG. 7) on the work cloth 100 with the sewing machine 1, the user may affix the marker 120 onto the work cloth 100 at a location at which the embroidery pattern 140 is to be sewn. The sewing machine 1 captures an image of the affixed marker 120 by the image sensor 50 (see FIG. 2) and recognizes the marker 120 by performing image processing on the obtained image information. More specifically, the sewing machine 1 identifies the center 110 of the first circle 101 and an inclination of the straight line that extends from the center 110 to the center 111 of the second circle 102 (see FIG. 10). The center 110 of the first circle 101 is hereinafter referred to as a "reference marker position" and the inclination of the straight line that extends from the center 110 of the first circle 101 to the center 111 of the second circle 102 is hereinafter referred to as a "reference marker angle". Further, based on the reference marker position and the reference marker angle, the sewing machine 1 specifies a sewing position and a sewing angle of an embroidery pattern on the work cloth 100 and then performs sewing of the embroidery pattern. The processing will be described in detail later.

Next, an example of the pattern data 146 of the embroidery pattern 140 stored in the pattern data storage area 202 (see FIG. 4) of the ROM 62 will be described below with reference to FIG. 7.

Figure 7:
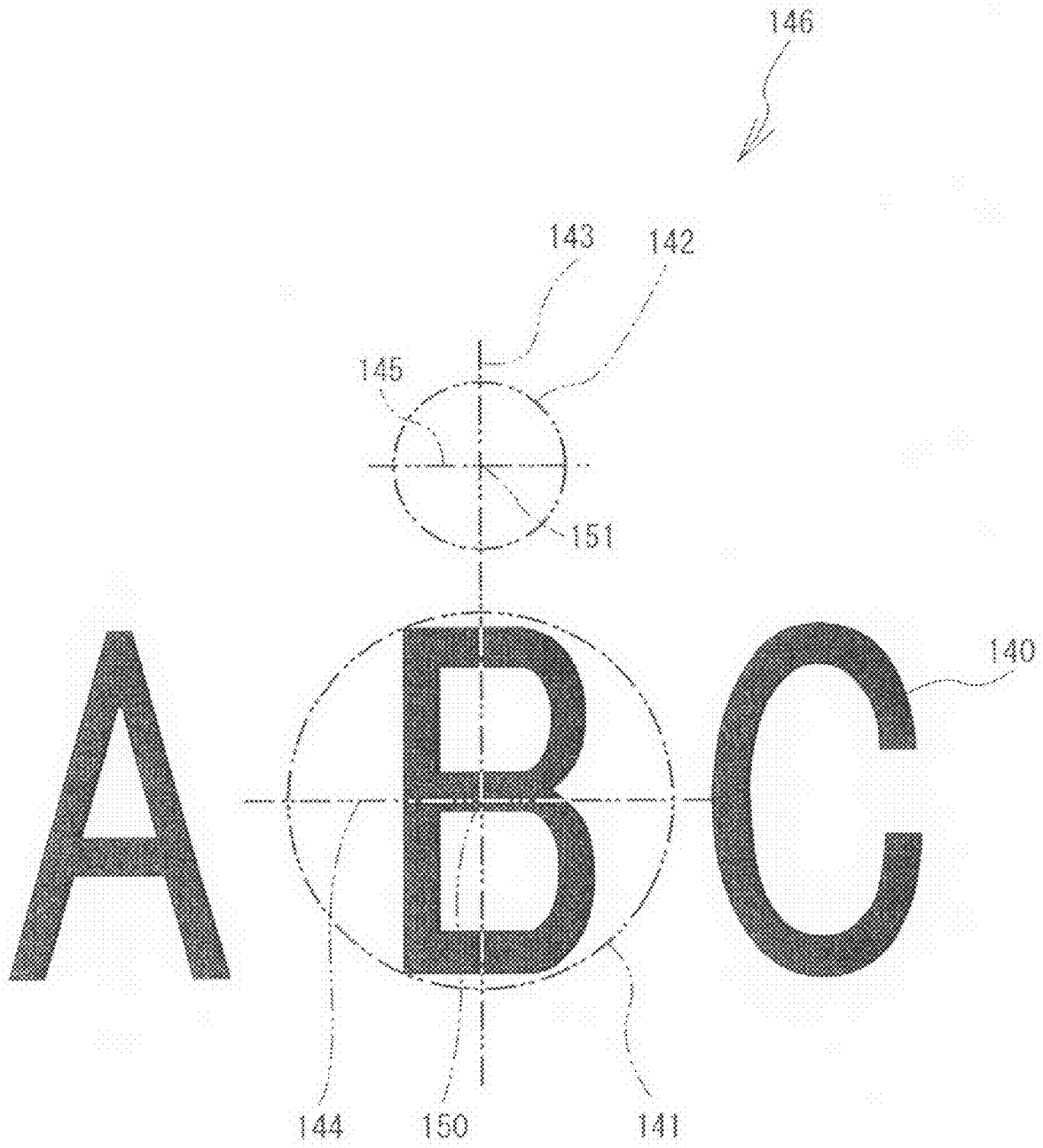
FIG. 7 is a conceptual view of pattern data stored in an embroidery data storage area of the ROM.

As shown in FIG. 7, the pattern data 146 includes embroidery data and reference line data. The embroidery data is data to identify a shape and a color of the embroidery pattern 140 ("ABC" in the example of FIG. 7). The reference line data is data to identify shapes of the circumference (circumferences 141 and 142 in FIG. 7) and the line segments (line segments 143 to 145 in FIG. 7). Of the embroidery data and the reference line data, the reference line data is used to specify the sewing position and the sewing angle of the embroidery pattern 140 on the work cloth 100 (see FIG. 1). In other words, the pattern data 146 of the present embodiment is a combination of conventional embroidery data for sewing the embroidery pattern 140 and the additional reference line data for determining the position and direction (angle) of the embroidery pattern 140 to be sewn on the work cloth 100. Accordingly, using the reference line data, the user can designate beforehand a desired position to be used for position determination, rather than the center point of an outline of the embroidery pattern 140. Using the reference line data, the user can also designate beforehand the direction (angle) of the embroidery pattern 140. Furthermore, the processing can be efficiently carried out simply because it is unnecessary to calculate a reference position for determining the position of the embroidery pattern.

In the present embodiment, the reference line data identifies the shapes of a first reference circle 141, a second reference circle 142, and reference line segments 143, 144, and 145. The embroidery data and the reference line data each contains coordinate information as position information in a three-dimensional space. Based on the coordinate information, the positions of the graphics (the embroidery pattern 140, the first reference circle 141, the second reference circle 142, and the reference line segments 143 to 145) identified by the embroidery data and the reference line data and the positional relationships among these graphics are defined in the three-dimensional space.

In the example shown in FIG. 7, the graphic "ABC" is the embroidery pattern 140 to be actually sewn on the work cloth 100 (see FIG. 1). The first reference circle 141 is superimposed over "B" of the embroidery pattern. The second reference circle 142 that has a smaller diameter than the first reference circle 141 is disposed above the first reference circle 141. Three reference line segments 141, 142, and 143 are disposed as follows. The reference line segment 143, which is a linear line segment, extends vertically through a center 150 of the first reference circle 141 and a center 151 of the second reference circle 142. The reference line segment 144 extends in a direction that orthogonally intersects with the reference line segment 143 at the center 150 of the first reference circle 141. The reference line segment 145 extends in the direction that orthogonally intersects with the line segment 143 at the center 151 of the second reference circle 142.

The position of the center 150 of the first reference circle 141 is hereinafter referred to as a "reference pattern position". The inclination of the straight line that extends from the center 150 of the first reference circle 141 to the center 151 of the second reference circle 142 is hereinafter referred to as a "reference pattern angle". In the present embodiment, the embroidery pattern 140 may be sewn at such a position that the reference pattern position coincides with the reference marker position of the marker 120 (see FIG. 6) affixed onto the work cloth 100, and at such an angle that the reference pattern angle coincides with the reference marker angle of the marker 120 affixed onto the work cloth 100.

In the example of FIG. 7, the reference pattern position is set at the center point of the outline of the embroidery pattern 140. The reference pattern position, however, does not always have to be set at the center point. For example, the reference pattern position may be set at the upper left base point of an outline rectangle of a component pattern "A", among the plurality of component patterns "A", "B", and "C" that constitute the embroidery pattern 140. Similarly, the reference pattern angle does not always have to be set in the direction of the embroidery pattern 140, either. For example, in FIG. 7, the straight line that extends from the center 150 of the first reference circle 141 to the center 151 of the second reference circle 142 may be inclined with respect to the vertical direction of FIG. 7. Processing will be described in detail later in which the embroidery pattern 140 is sewn in accordance with the reference marker position and the reference marker angle.

Figure 8:
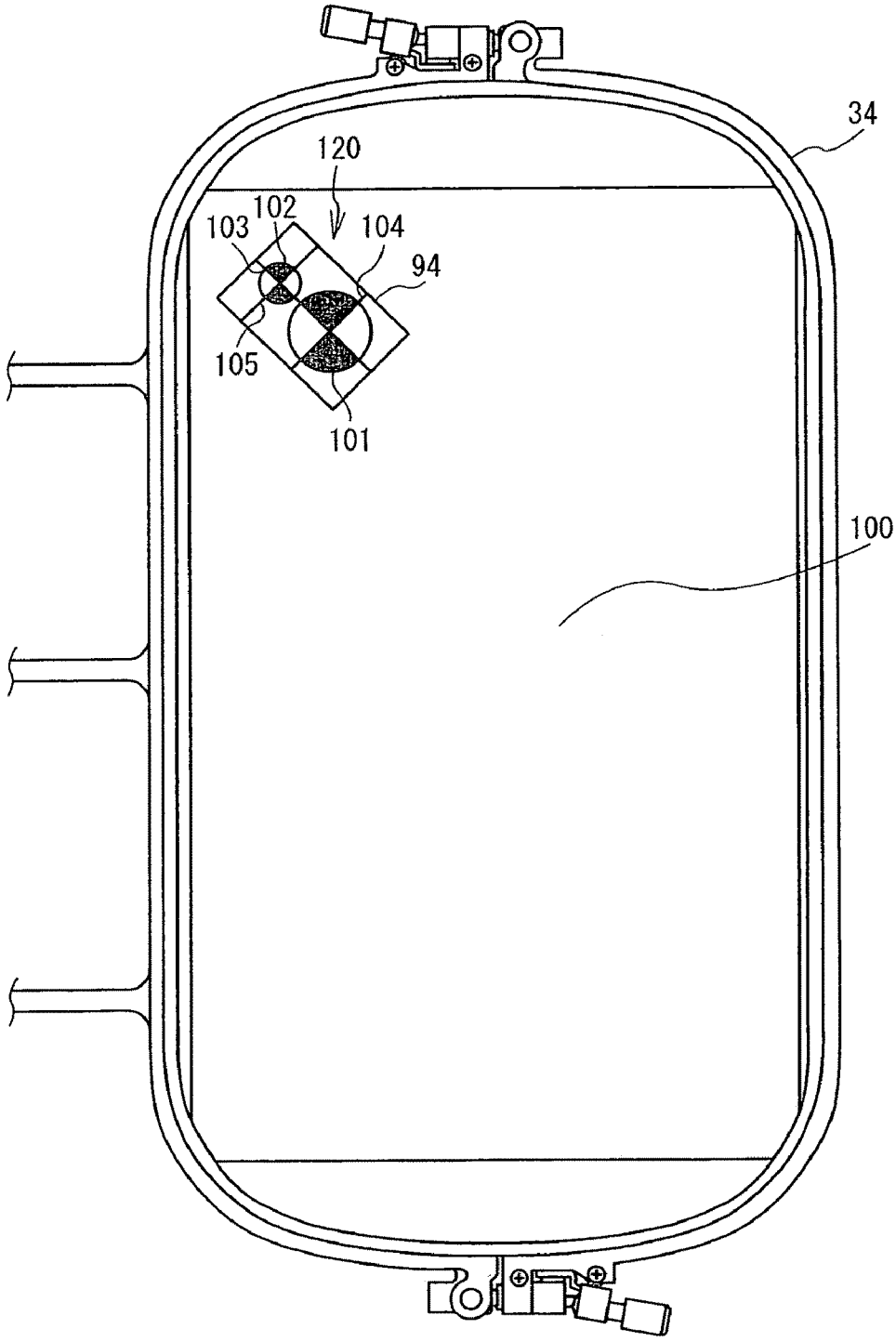
FIG. 8 is an illustration of an example of a work cloth with the marker affixed thereon.

A condition in which the marker 120 is affixed to the work cloth 100 will be described below with reference to FIG. 8. Prior to sewing the embroidery pattern 140 (see FIG. 7) on the work cloth 100, the user may affix the marker 120 to a desired sewing position and at a desired sewing angle on the work cloth 100 held by the embroidery frame 34. By thus affixing the marker 120 on the work cloth 100 after the work cloth 100 is attached to the embroidery frame 34, the user need not care about the position or the angle of the marker 120 when the user attaches the work cloth 100 to the embroidery frame 34. An example shown in FIG. 8 shows a condition in which the marker 120 is affixed onto the work cloth 100 by the user who wishes to sew the embroidery pattern 140 at the left rear portion of the work cloth 100 and inclined leftward by about 45 degrees with respect to the front-and-rear direction of the sewing machine 1. As shown in FIG. 8, the marker 120 affixed at the left rear portion of the work cloth 100 has the line segment 103 inclined leftward by about 45 degrees with respect to the front-and-rear direction of the sewing machine 1. Along the line segment 103, the second circle 102 is disposed to the rear side of the sewing machine 1 and the first circle 101 is disposed to the front side of the sewing machine 1.

As described earlier, the adhesive is applied over the back surface of the base material sheet 94 of the marker 120. Therefore, if the position to which or the angle at which the marker 120 has been affixed on the work cloth 100 is different from a desired position or angle of the user, the user can peel off the marker 120 from the work cloth 100 and affix the marker 120 onto the work cloth 100 again. By thus using the marker 120 that can be affixed onto the work cloth 100, the user can adjust the position and the angle as many times as desired.

Figure 9:
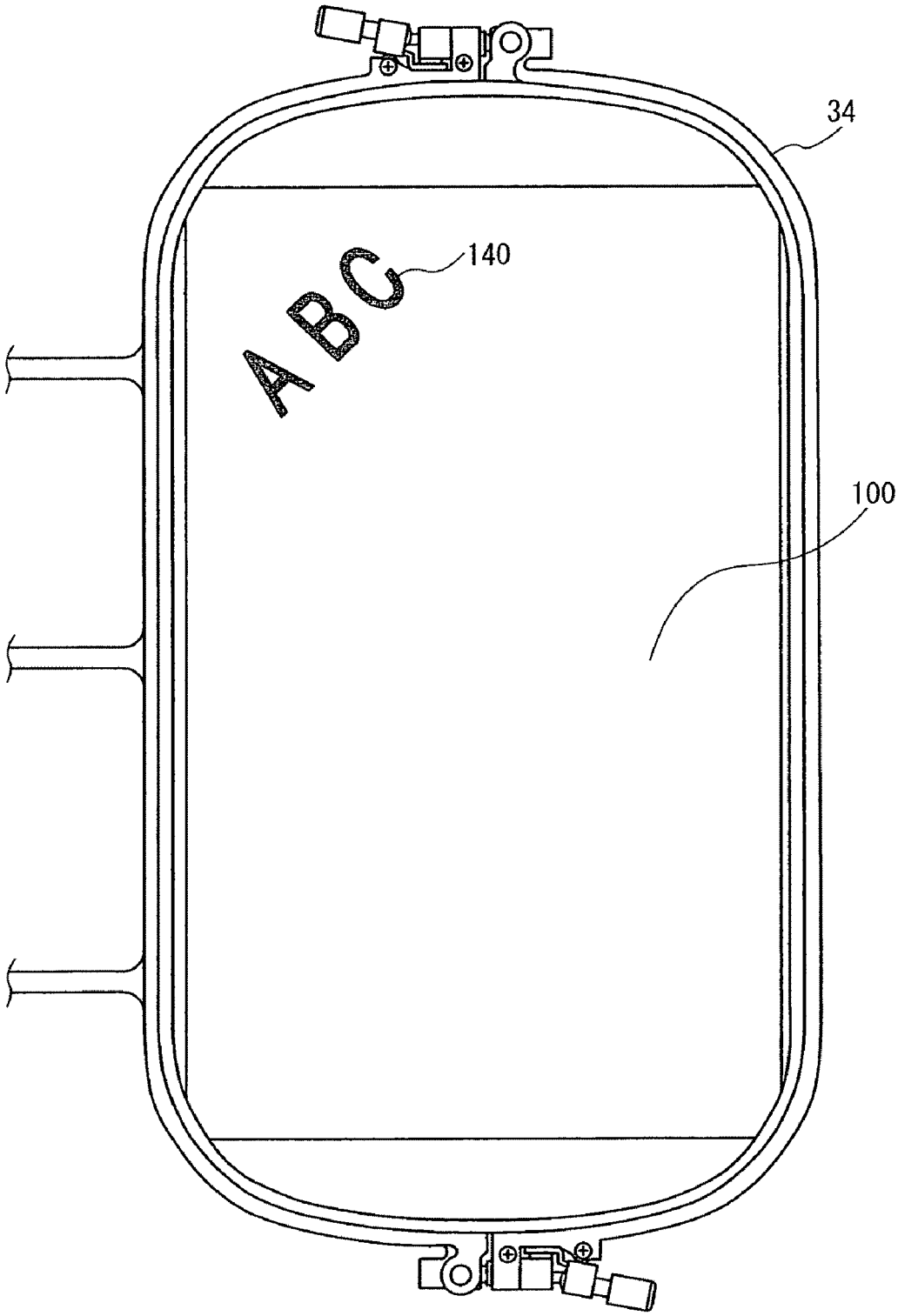
FIG. 9 is an illustration of an example of a work cloth with an embroidery pattern sewn thereon.

Next, a condition in which the embroidery pattern 140 has been sewn on the work cloth 100 will be described below with reference to FIG. 9. FIG. 9 shows an example in which the graphic "ABC" shown in FIG. 7 is selected as the embroidery pattern 140. In the present embodiment, it is assumed that once an image of the marker 120 affixed to the work cloth 100 is captured by the image sensor 50 of the sewing machine 1 and the marker 120 is recognized to specify a sewing position and a sewing angle of the embroidery pattern 140, the marker 120 will be peeled off by the user. Therefore, the embroidery pattern 140 will not be sewn over the marker 120 remaining affixed on the work cloth 100.

FIG. 9 shows the embroidery pattern 140 that has been sewn in a condition were the reference marker position 110 of the marker 120 (see FIG. 6) coincides with the reference pattern position 150 of the pattern data 146 (see FIG. 7), and the reference marker angle of the marker 120 (see FIG. 6) coincides with the reference pattern angle of the pattern data 146. In an example shown in FIG. 9, the graphic "ABC" (the embroidery pattern 140) has been sewn at the left rear portion of the work cloth 100 where the marker 120 was affixed as shown in FIG. 8 and inclined leftward by about 45 degrees with respect to the front-and-rear direction of the sewing machine 1.

In such a manner, the user may affix the marker 120 onto the work cloth 100 at a desired sewing location of the embroidery pattern 140. Then, the sewing machine 1 may detect a position to which and an angle at which the marker 120 has been affixed, and identify a sewing position and a sewing angle, thereby appropriately executing sewing of the embroidery pattern 140. Thus, the need of setting a position and an angle for embroidery sewing, which is conventionally performed by the user through key operations, may be eliminated, thus facilitating sewing an embroidery pattern to a desired position and at a desired angle.

Next, processing in which the sewing machine 1 detects the marker 120 affixed on the work cloth 100 and determines a sewing position and a sewing angle of the embroidery pattern 140 will be described below with reference to FIGS. 10 to 15.

Figure 10:
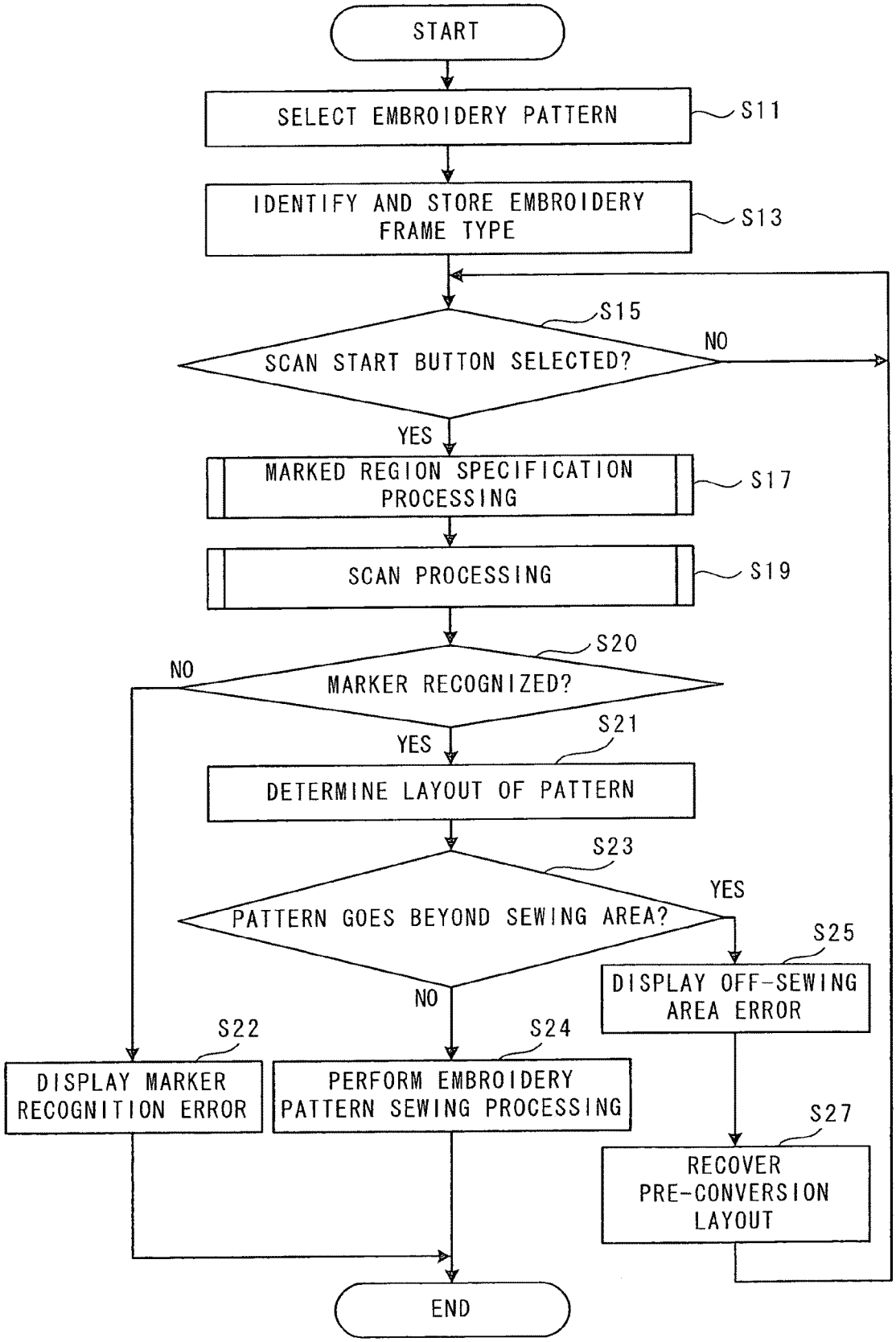
FIG. 10 is a main flowchart of sewing position determination processing.

A main flowchart of sewing position determination processing will be described below with reference to FIG. 10. As shown in FIG. 10, in the sewing position determination processing, first an embroidery pattern 140 (see FIG. 7) to be sewn selected by the user is detected (SI 1). The user may select a desired embroidery pattern 140 through panel operations from among a plurality of the embroidery patterns 140 indicated on the LCD 15 (see FIG. 1). Information about which one of the embroidery patterns 140 is selected is detected and recognized on the touch panel 26 (see FIG. 1). The pattern data 146 (see FIG. 7) to sew the selected embroidery pattern 140 is read from the pattern data storage area 202 (see FIG. 4) of the ROM 62, and stored into the selected pattern storage area 211 (see FIG. 5) of the RAM 63. Accordingly, the embroidery pattern 140 selected by the user may be determined as the embroidery pattern to be sewn.

Subsequently, the embroidery frame 34 (see FIG. 1) that holds the work cloth 100 may be attached to the carriage by the user. The embroidery pattern 140 will be sewn on the work cloth 100 held by the attached embroidery frame 34. The embroidery frame 34 may be attached prior to the start of the sewing position determination processing.

Figure 11:
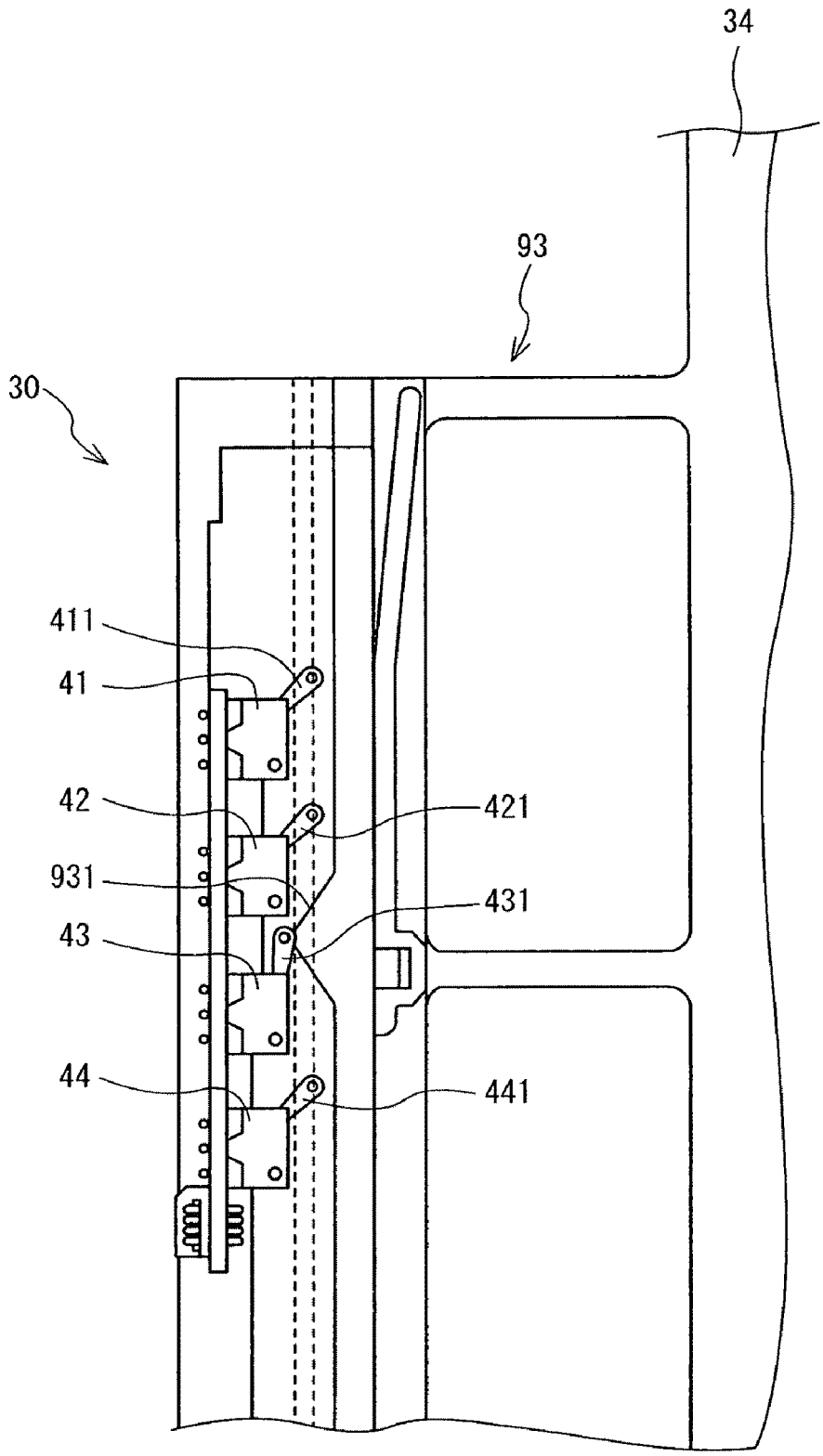
FIG. 11 is a plan view of a frame type determination mechanism provided to a carriage.

A frame determination mechanism 30 provided to the carriage (not shown) will be described below with reference to FIG. 11. As shown in FIG. 11, an attachment portion 93 provided on the left side of the embroidery frame 34 has a convex portion 931 protruding from a position that varies depending on the shape and the type of the embroidery frame 34. When the attachment portion 93 of the embroidery frame 34 is attached to the frame attachment portion of the carriage, the convex portion 931 presses leftward any one of levers 411, 421, 431, and 441 of the respective four determination switches 41, 42, 43, and 44 provided in line on the frame attachment portion. In an example of FIG. 11, the lever 431 is pressed leftward to turn ON the determination switch 43. By detecting the ON-state or the OFF-state of the respective four determination switches 41 to 44, the type of the attached embroidery frame 34 may be identified. In accordance with the identified type of the embroidery frame 34, frame information of the corresponding embroidery frame 34 is read from the frame information storage area 203 (see FIG. 4) of the ROM 62, and stored into the attached frame information storage area 212 (see FIG. 5) of the RAM 63 (S13). As described in detail later, the stored frame information will be used to determine whether the embroidery pattern 140 can be sewn on the work cloth 100 (S23). Specifically, the determination may be made based on whether the embroidery pattern 140 fits within a sewing area of the embroidery frame 34 or the embroidery pattern 140 goes beyond the sewing area.

After the frame information corresponding to the identified type of the embroidery frame 34 is stored in the frame information storage area 203, the user may affix the marker 120 on the work cloth 100 held by the embroidery frame 34 at a location where the embroidery pattern 140 is to be sewn.

Subsequently, a scan operation start button is displayed on the LCD 15. The CPU 61 waits until the user selects the displayed scan operation start button through panel operations to instruct the start of processing to recognize the marker 120 affixed onto the work cloth 100 (NO at S15). If it is detected on the touch panel 26 that the user has selected the scan operation start button (YES at S15), the CPU 61 proceeds to marked region specification processing, in which the marked region is specified (S17).

Next, the marked region specification processing will be described below with reference to FIGS. 12 and 13. In the marked region specification processing, first the information of the marked region is accepted from the user. After an image of the work cloth 100 is captured by the image sensor 50 (see FIG. 2), image information that corresponds to the accepted marked region is extracted out of the obtained image information, which will be subjected to image processing. Based on the extracted image information, the marker 120 may be recognized. Thus, time to recognize the marker 120 can be shortened.

Figure 12:
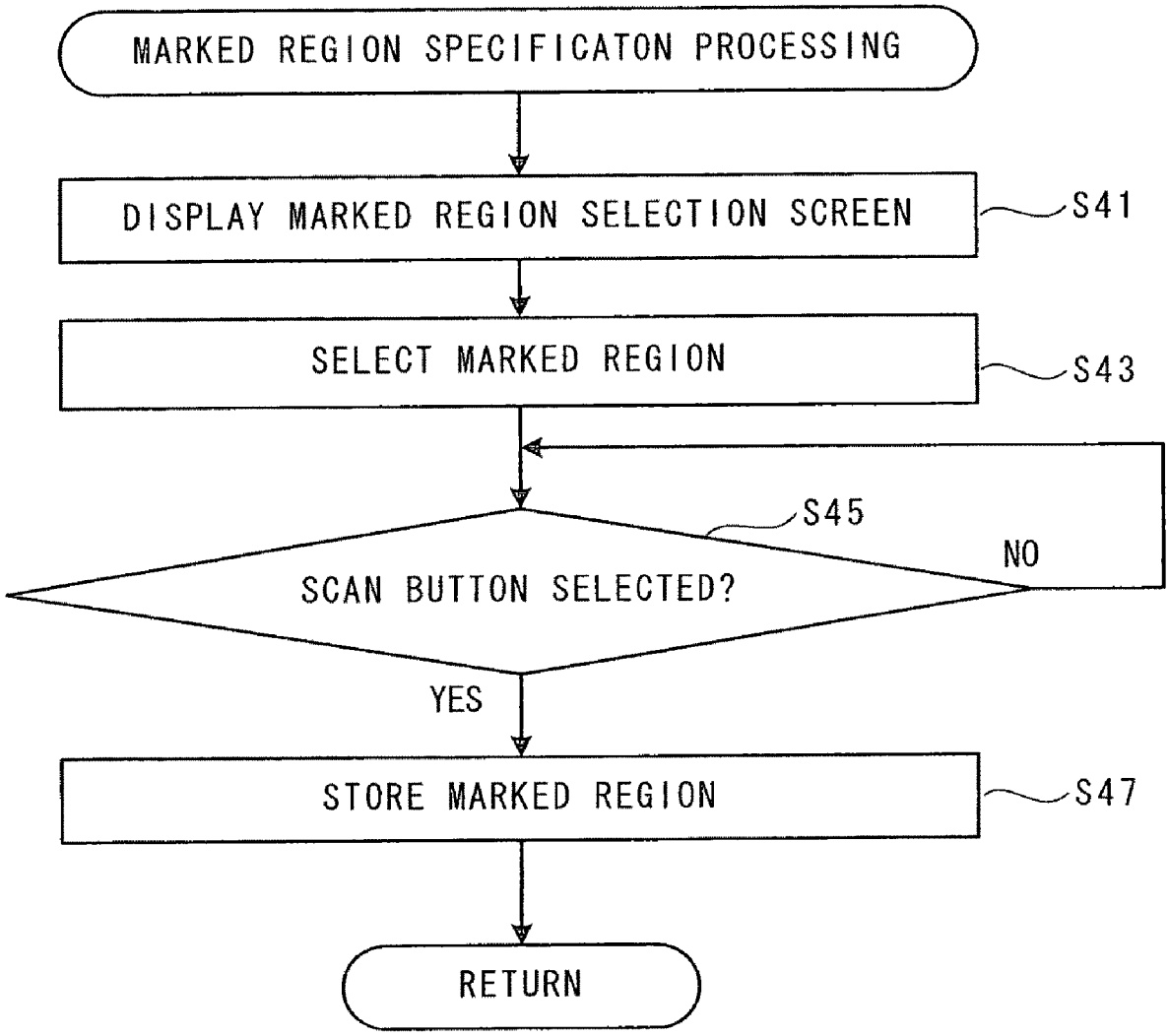
FIG. 12 is a subroutine flowchart of marked region specification processing.
Figure 13:
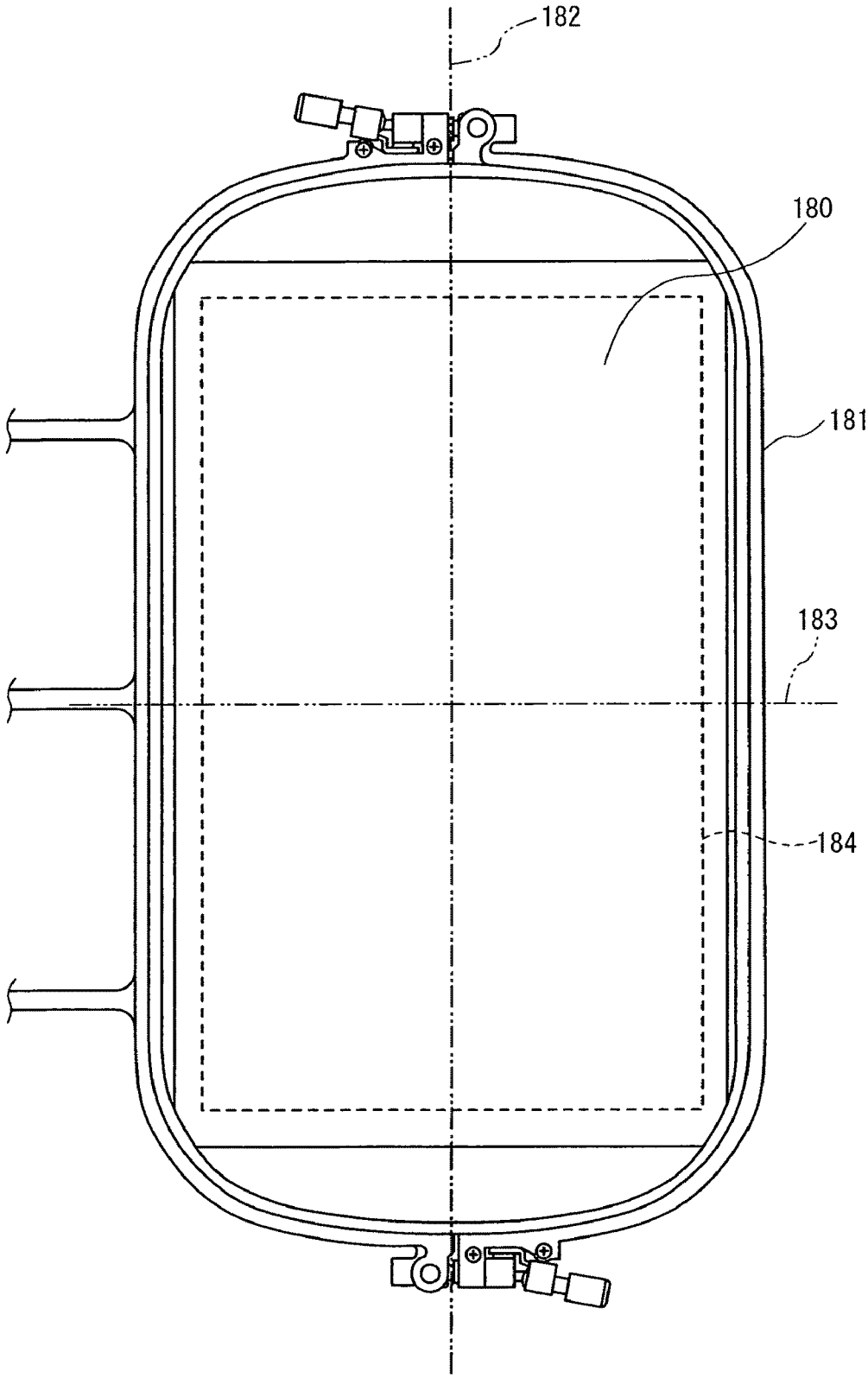
FIG. 13 is an illustration of an example of a screen displayed on a liquid crystal display in sewing position determination processing.

As shown in FIG. 12, in the marked region specification processing, first the LCD 15 displays a screen on which the user can select a region of a specific portion of the work cloth 100 (S41). The screen prompts the user to select any one of the divided regions of the work cloth 100 as the marked region.

An example of the screen displayed on the LCD 15 at step S41 of the marked region specification processing shown in FIG. 12 will be described below with reference to FIG. 13. In the example shown in FIG. 13, the LCD 15 displays an image 180 of the work cloth 100 and an image 181 of the embroidery frame 34. Dashed-two dotted lines 182 and 183 are also displayed. The dashed-two dotted line 182 vertically extends through midpoints of the respective upper and lower sides of the image 181 of the embroidery frame 34. The two-dot-and-dash line 183 horizontally extends through midpoints of the respective right and left sides of the image 181 of the embroidery frame 34. Thus, the entire region of image 180 of the work cloth 100 is divided into four regions by the two-dot-and-dash lines 182 and 183. Further, a rectangular range defined by a broken line 184 indicates a maximum region in which embroidery can be sewn within the embroidery frame 34, that is, a sewing area.

It should be noted that the two-dot-and-dash lines 182 and 183 may be set in such a manner that the area of each of the divided regions formed by dividing the work cloth 100 with the two-dot-and-dash lines may be smaller than an imaging area that can be captured by the image sensor 50 at a time. Accordingly, by selectively extracting a part of the imaging information obtained by image capturing by the image sensor 50, the quantity of information for recognizing the marker 120 in the image processing can be reduced. Thus, time to recognize the marker 120 can be shortened. It should be noted that the arrangement of the two-dot-and-dash lines that divide the image 180 of the work cloth 100 displayed on the LCD 15 at step S41 of FIG. 12 may vary according to the shape and the size of the embroidery frame 34 attached to the carriage.

The user may perform panel operations to select the marked region from among the four regions obtained by dividing the image 180 of the work cloth 100 by the two-dot-and-dash lines 182 and 183. The select input by the user is detected by the touch panel 26 (S43), and a scan start button is displayed on the LCD 15. The CPU 61 waits until the scan start button is selected by the user's panel operations to instruct start of scanning (NO at S45). If the selection of the scan start button is detected by the touch panel 26 (YES at S45), the information of the region of the work cloth 100 selected by the user at step S43 (hereinafter referred to as "marked region information") is stored in the marked region storage area 213 (see FIG. 5) of the RAM 63 (S47). The marked region information will be read and used when performing recognition processing on the marker 120, which will be described later (see S67 of FIG. 14). The CPU 61 ends the marked region specification processing, returns to the main processing (see FIG. 10), and then executes scan processing (see S19 of FIG. 10).

In such a manner, the information about which one of the regions on the work cloth 100 the marker 120 is affixed to is acquired from the user. Accordingly, it is possible to perform the recognition processing on the marker 120, preferentially using the image information of a specific region of the entire image information obtained by image capturing by the image sensor 50. Since a lot of computation and processing is usually required to recognize the marker 120, a certain level of time is required. In contrast, the time required to recognize the marker 120 can be shortened by thus limiting the image information. As described in detail later, there may be some cases where the marker 120 cannot be recognized because the user has selected a wrong marked region for the marker 120. In such a case, the CPU 61 may recognize the marker 120 by referring to the other remaining image information (see S68 of FIG. 14), or transfers the embroidery frame 34 and captures an image of any other region of the work cloth 100 (see S72 of FIG. 14). It is thus possible to reduce the possibility that the marker 120 is not detected.

Figure 14:
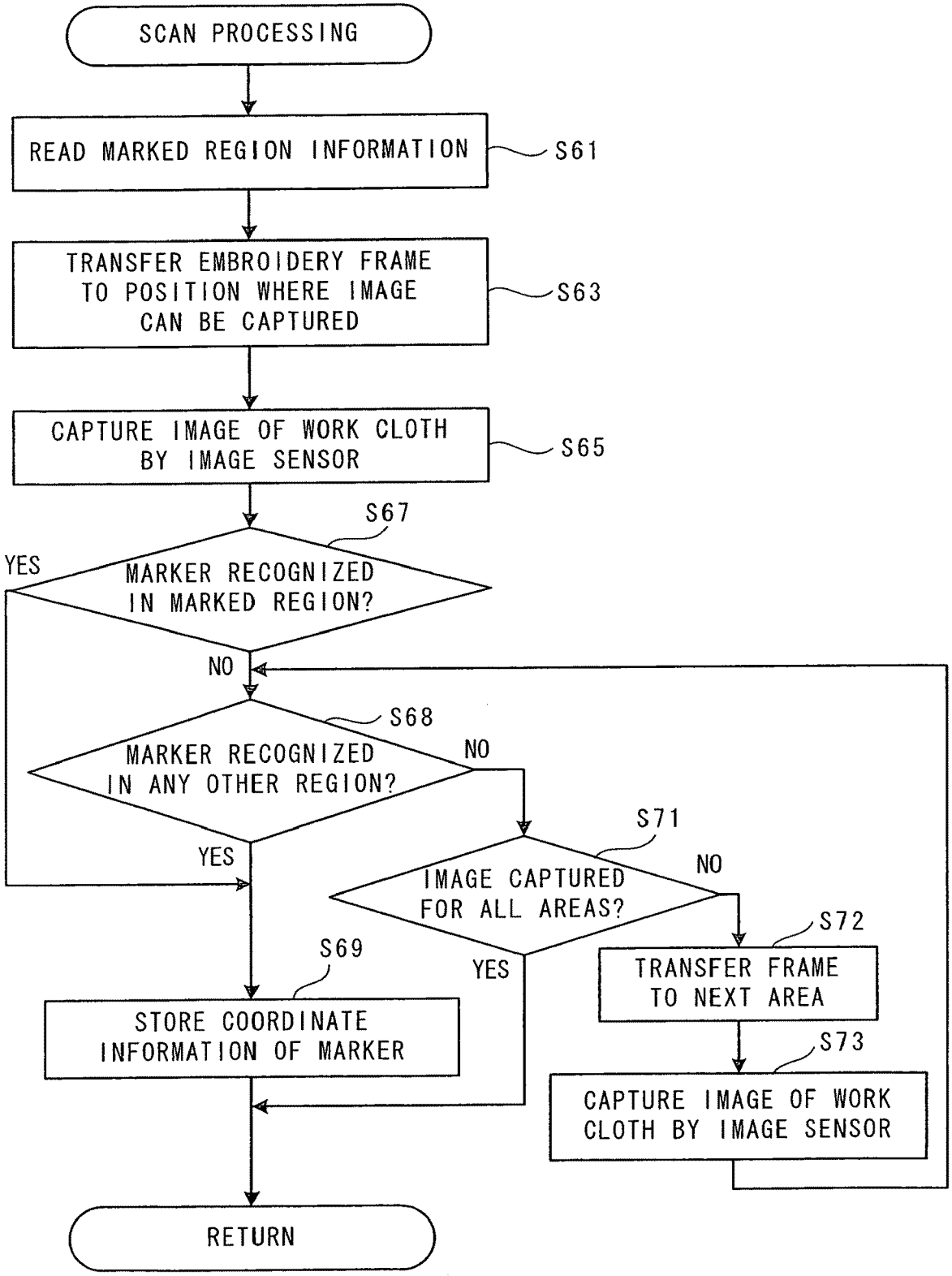
FIG. 14 is a subroutine flowchart of scan processing.

Next, the scan processing (see S19 of FIG. 10) will be described below with reference to FIG. 14. As shown in FIG. 14, in the scan processing, first the marked region information that has been stored in the marked region storage area 213 of the RAM 63 at step S47 in the marked region specification processing (see FIG. 12) is read (S61). The embroidery frame 34 is transferred to a position at which the image sensor 50 can capture an image of the region of the work cloth 100 that is identified by the read marked region information (S63). An image of the work cloth 100 is captured (S65). Image information thus obtained is stored in the image information storage area 215 (see FIG. 5).

Subsequently, the image information that corresponds to the region identified by the marked region information read at step S61, that is, the marked region, is extracted from the entire image information obtained as a result of image capturing by the image sensor 50 at step S65, and stored into the image information storage area 215 of the RAM 63. Then, processing to recognize the marker 120 affixed to the work cloth 100 is executed, and determination is made as to whether the marker 120 affixed to the marked region has been successfully recognized (S67).

Figure 15:
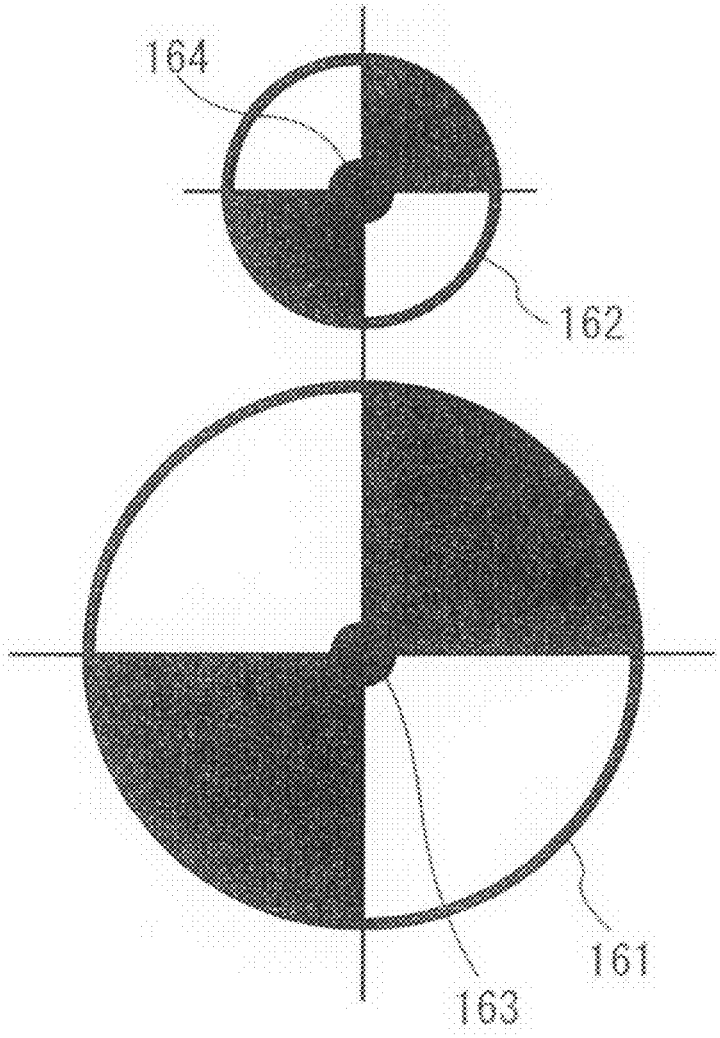
FIG. 15 is an explanatory drawing of a process in marker recognition processing to recognize the marker from information obtained by image capturing.

The outline of a method of recognizing the marker 120 based on the image information will be described below with reference to FIGS. 15 and 16. As shown in FIG. 15, by using the known technique of Hough transform, for example, circumferences of the circles 161 and 162 are extracted from the extracted image information, and coordinates of the centers 163 and 164 and radii of the respective circles 161 and 162 are respectively calculated. At this point, in addition to the first circle 101 and the second circle 102 (see FIG. 6) on the marker 120 affixed onto the work cloth 100, a circle contained in a texture pattern of the work cloth 100, for example, may also be extracted. The calculated coordinates of the circle centers are hereinafter referred to as (a, b) ((a1, b1), (a2, b2), (a3, b3), . . . ), and the calculated radii of the circles are hereinafter referred to as r (r1, r2, r3, . . . ).

Figure 16:
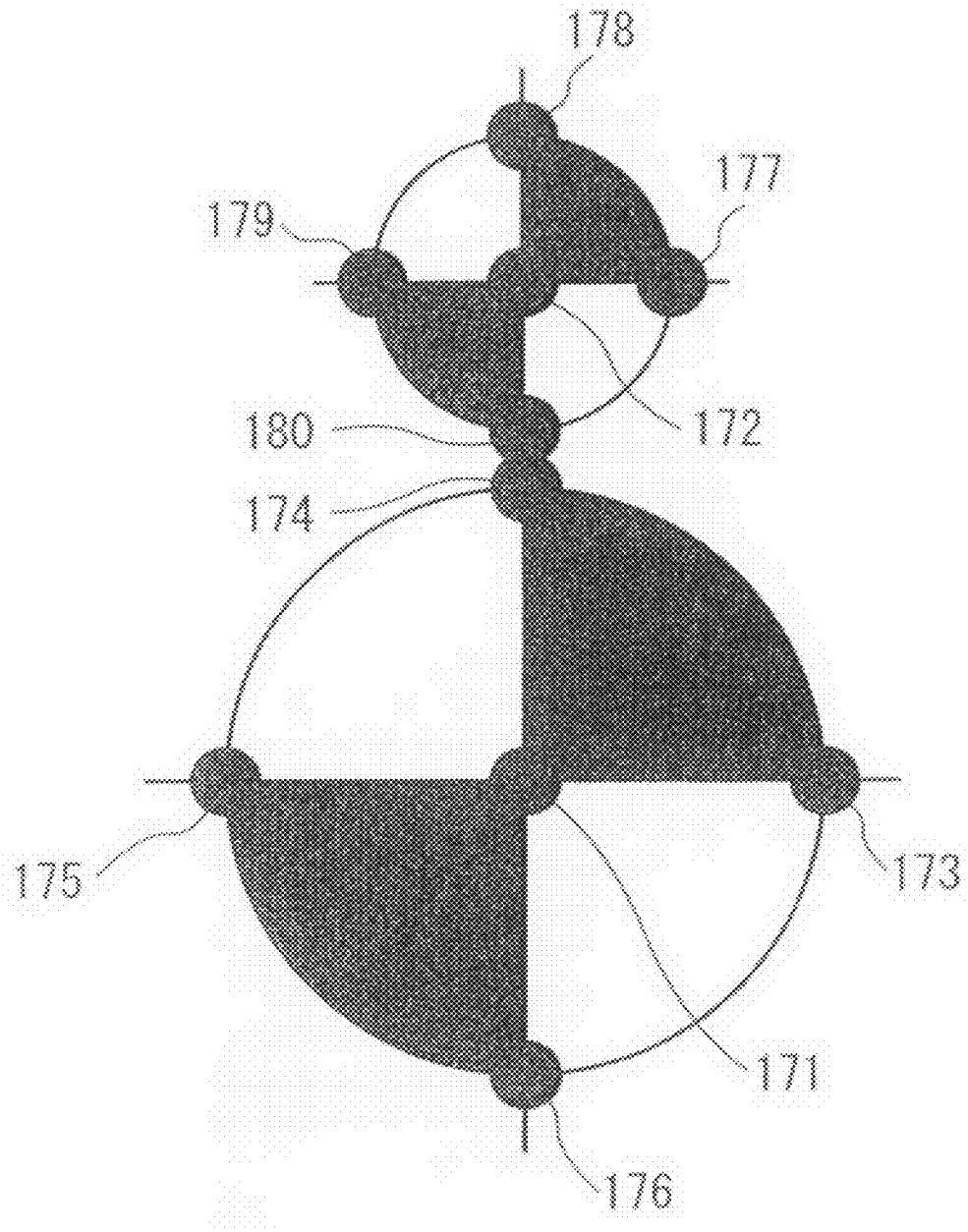
FIG. 16 is an explanatory drawing of another process in the marker recognition processing.

Further, as shown in FIG. 16, by using the known technique of Harris Operator, for example, coordinates 171 to 180 of corners are calculated from the extracted image information. It should be noted that the corner refers to an intersection point at which a plurality of edges (portions comprised of one line, such as a contour) intersect with each other, among portions such as borderlines where brightness changes suddenly. The calculated coordinates of the corners are hereinafter referred to as (A, B) ((A1, B1), (A2, B2), (A3, B3), . . . ).

The center coordinates (a, b) and radius r obtained through Hough transform and the corner coordinates (A, B) obtained through Harris Operator are compared with each other. If there are any coordinates (A, B) that coincide with any coordinates (a, b) and there are any other coordinates (A, B) that coincide with coordinates of a position at a distance of the radius r from a center coordinates (a, b), it is determined that these coordinates are respectively the coordinates of the center of the circle and the coordinates of an intersection between the circumference and the line segment on the marker 120 shown in FIG. 6. In other words, the coordinates (A, B) that coincide with the coordinates (a, b) are determined as the coordinates of the center of the first circle 101 or the second circle 102. Further, the coordinates (A, B) that coincide with the coordinates of the position at a distance of the radius r from the center coordinates (a, b) are determined as the coordinates of the intersection between the first circle 101 and the line segment 103 or 104, or the coordinates of the intersection between the second circle 102 and the line segment 103 or 105. From among the coordinates determined as the coordinates of the center of the first circle 101 or the coordinates of the center of the second circle 102, the coordinates that correspond to the larger radius obtained through Hough transform are extracted as center coordinates (P, Q) of the first circle 101. On the other hand, the coordinates that correspond to the smaller radius obtained through Hough transform are extracted as the center coordinates (p, q) of the second circle 102.

Subsequently, the coordinates (P, Q) and (p, q) of the extracted two points are converted into coordinates in the three-dimensional real space. The coordinates obtained as a result of the conversion are defined as center coordinates (P', Q', S) of the first circle 101 and center coordinates (p', q', s) of the second circle 102, respectively. Thus, the positions of the center of the first circle 101 and the second circle 102 can be recognized in the real space. The center coordinates (P', Q', S) of the first circle 101 correspond to the reference marker position and the inclination of a straight line that extends from (P', Q', S) to the center coordinates (p', q', s) of the second circle 102 corresponds to the reference marker angle.

By thus executing the image processing, the center coordinates of the first circle 101 and the center coordinates of the second circle 102 on the marker 120 affixed to the work cloth 100 are recognized, and the reference marker position and the reference marker angle (marked position and marked angle respectively) are calculated. As described in detail later, the reference marker position is taken as a reference for the sewing position of the embroidery pattern 140 and the reference marker angle is taken as a reference for the sewing angle of the embroidery pattern 140.

When the marker 120 is not recognized as a result of the image processing at step S67 in FIG. 14 (NO at S67), there is a possibility that the marker 120 may have been affixed in a region different from the region selected by the user as the marked region. Therefore, the same recognition processing on the marker 120 as described above is executed on the image information of other regions than the region selected by the user as the marked region (see S43 of FIG. 12) of the entire image information obtained by image capturing by the image sensor 50 and stored in the image information storage area 215 (see FIG. 5) of the RAM 63. Then, determination is made as to whether the marker 120 affixed in any other region is recognized (S68).

If the marker 120 is recognized at step S67 (YES at S67) or at step S68 (YES at S68), the center coordinates (P', Q', S) of the first circle 101 and the center coordinates (p', q', s) of the second circle 102 obtained through the processing to recognize the marker 120 are stored in the marker position information storage area 214 of the RAM 63. The CPU 61 ends the scan processing and returns to the main processing (see FIG. 8).

When the marker 120 is not recognized based on the image information stored in the image information storage area 215 of the RAM 63 (NO at S68), it is determined that the marker 120 has not been affixed in the region of which the image was captured at step S65. Therefore, the image sensor 50 captures an image of any other remaining region of the work cloth 100 of which the image was not captured at step S65, and the recognition processing on the marker 120 is performed. If there remains any region of the work cloth 100 of which the image has not been captured by the image sensor 50 and thus for which the recognition processing on the marker 120 has not been performed (NO at S71), the CPU 61 transfers the embroidery frame 34 to a position at which the image sensor 50 can capture an image of the remaining region of the work cloth 100 (S72). The CPU 61 controls the image sensor 50 to capture the image of the work cloth 100 (S73) and returns to step S68 to repeat recognition processing on the marker 120. If the marker 120 is not recognized even after capturing images of the entire region of the work cloth 100 by the image sensor 50 and performing recognition processing on the marker 120 (YES at S71), the CPU 61 determines that the marker 120 has not been affixed onto the work cloth 100 and ends the scan processing to return to the main processing (see FIG. 10).

As shown in the main processing shown in FIG. 10, if the marker 120 was recognized in the scan processing (SI 9), the CPU 61 refers to the center coordinates (P', Q', S) of the first circle 101 and the center coordinates (p', q', s) of the second circle 102 stored in the marker position information storage area 214 of the RAM 63 (see FIG. 5), to thereby determine a layout on the work cloth 100 of the embroidery pattern 140 selected by the user at step S11 (S21). The pattern data 146 of the embroidery pattern 140 selected by the user is stored in the selected pattern storage area 211 (see FIG. 5) of the RAM 63.

As previously described with reference to FIG. 7, the pattern data 146 contains the coordinate information as position information in the three-dimensional plane, and the reference pattern position and the reference pattern angle are defined. Therefore, the reference pattern position and the reference pattern angle in the embroidery data 146 are converted based on the center coordinates (P', Q', S) of the first circle 101 and the center coordinates (p', q', s) of the second circle 102 of the marker 120. Then, the coordinates identified by the position information of the embroidery pattern 140 are respectively converted using the same conversion quantity as that of the former conversion.

The embroidery pattern 140 will be sewn on the work cloth 100 in such a manner that the reference marker position of the marker 120 affixed onto the work cloth 100 may coincide with the reference pattern position in the pattern data 146, and the reference marker angle of the marker 120 may coincide with the reference pattern angle in the pattern data 146. Therefore, first a conversion quantity is calculated that is required to convert the reference pattern position and the reference pattern angle predetermined in the pattern data 146 into the reference marker position and the reference marker angle of the marker 120. Then, the position information of the embroidery pattern 140 is converted by using the calculated conversion quantity, thereby defining the sewing position and a sewing angle of the embroidery pattern 140.

At step S21, the CPU 61 calculates the conversion quantity that is required to match the reference pattern position in the pattern data 146 with the reference marker position of the marker 120. The calculated conversion quantity is hereinafter represented by ΔL. Subsequently, the CPU 61 calculates another conversion quantity that is required to match the reference pattern angle in the pattern data 146 with the reference marker angle of the marker 120. The calculated conversion quantity is hereinafter represented by ΔM. Subsequently, coordinate information that identifies the position of the embroidery pattern 140 in the pattern data 146, more specifically, coordinate information of the needle drop points of the embroidery pattern 140 contained in the embroidery data is converted using ΔL and ΔM. The obtained coordinate information is stored in the selected pattern storage area 211 of the RAM 63 (see FIG. 5) as new coordinate information that identifies the position and the angle of the embroidery pattern 140. In such a manner, the pattern data 146 of the embroidery pattern 140 that can be sewn to a location where the marker 120 is affixed may be determined.

On the other hand, if the marker 120 was not recognized in the scan processing (S19) (NO at S20), the CPU 61 controls the LCD 15 (see FIG. 1) to indicate an error that the marker 120 cannot be recognized (S22) and ends the main processing without performing sewing processing on the embroidery pattern 140.

If the marker 120 was recognized in the scan processing (S19) (YES at S20), after the coordinate information that identifies the position and the angle of the embroidery pattern 140 is calculated (S21), determination is made as to whether any of the calculated coordinates exist outside the embroidery sewing-enabled region of the embroidery frame 34, that is, the sewing area 184 (see FIG. 13) (S23). The frame information of the embroidery frame 34 that holds the work cloth 100 is stored in the attached frame information storage area 212 (see FIG. 5) of the RAM 63 at step S13. Therefore, information about the size of the embroidery frame in the stored frame information is read and determination is made as to whether all the coordinates of the embroidery pattern 140 exist in the sewing area 184 (embroidery sewing-enabled region).

When any of the coordinates of the embroidery pattern 140 exist outside the sewing area 184, that is, the embroidery pattern 140 goes beyond the sewing area 184 (YES at S23), the specified embroidery pattern 140 cannot be sewn at the position on the work cloth 100 specified by affixing the marker 120. Therefore, the CPU 61 controls the LCD 15 to indicate an error (an off-sewing area error) that the embroidery sewing cannot to be performed because the embroidery pattern 140 does not fit within the sewing area (S25), and prompts the user to peel off and affix the marker 120 again. The CPU 61 replaces the coordinate information that identifies the post-conversion position of the embroidery pattern 140 stored in the selected pattern storage area 211 of the RAM 63 with the pre-conversion coordinate information (S27), thereby clearing the calculated coordinate information. After the user who is notified of the error affixes the marker 120 again to such a position that the embroidery pattern 140 may fit within the sewing area 184, the process returns to step S15 and the recognition processing on the marker 120 is repeated. By thus using the marker 120 that can be affixed onto the work cloth 100, the user can adjust the position and the direction (angle) over again without the need of detaching the work cloth 100 from the embroidery frame 34 and then attaching the work cloth 100 to the embroidery frame 34 again.

On the other hand, when the embroidery pattern 140 fits within the sewing area of the embroidery frame 34 (NO at S23), the embroidery pattern 140 can be sewn at the position where the marker 120 is affixed, so that processing to sew the embroidery pattern 140 is executed (S24), and the main processing is terminated.

As described above, the user may affix the marker 120 onto the work cloth 100 at the desired location of the embroidery pattern 140. The reference marker position and the reference marker angle of the affixed marker 120 may be calculated based on the information obtained by image capturing by the image sensor 50. Based on the reference marker position and the reference marker angle, the sewing position and the sewing angle of the embroidery pattern may be identified. Specifically, the embroidery data that identifies the shape of the embroidery pattern with the coordinates of the needle drop points may be converted in such a manner that the reference marker position and the reference marker angle may respectively coincide with the reference pattern position and the reference pattern angle identified by the reference line data contained in the pattern data. By sewing the embroidery pattern 140 based on the post-conversion embroidery data, the user may not have to set the sewing position and the sewing angle through key operations. In other words, according to the sewing machine 1 of the present embodiment, it is possible for the user to sew an embroidery pattern by easily setting the sewing position and the sewing angle of the embroidery pattern with respect to the work cloth.

Since the marker 120 has a shape that enables identifying the sewing position and the sewing angle of the embroidery pattern 140, it is possible for the to sew the embroidery pattern 140 at a desired position and at a desired angle by adjusting a position to which and an angle at which the marker 120 is affixed.

Further, in the case of capturing an image of the upper surface of the work cloth 100 with the image sensor 50 in order to recognize the marker 120, the marker 120 may not be affixed in an area where the image sensor 50 can capture the image. In such a case, by transferring the embroidery frame 34 that holds the work cloth 100, it is possible to make the marker 120 exist in an area where the image sensor 50 can capture an image. Accordingly, even in a case where the area of the work cloth 100 is larger than the imaging area of the image sensor 50 and thus, an image of the entire area of the work cloth 100 cannot be captured by the image sensor 50 at a time, it is possible to capture an image including a location on the work cloth 100 where the marker 120 is affixed. Since the embroidery frame 34 is automatically transferred, the marker 120 disposed on the work cloth 100 is automatically recognized, and the sewing position and the sewing angle of the embroidery pattern may be specified. Accordingly, it is unnecessary for the user to move the marker 120 manually to a region where the image sensor 50 can capture the image of the marker 120. Moreover, by prompting the user to specify the region on the work cloth 100 where the marker 120 has been affixed by user's operations, it is possible to recognize the marker 120 by performing recognition processing only on the image information of the specified region of the entire image information obtained by image capturing by the image sensor 50. In such a case, time to recognize the marker 120 can be shortened.

It should be noted that the present disclosure is not limited to the described exemplary embodiment and can be modified variously.

The marker 120 of the above-described exemplary embodiment includes the first circle 101 and the second circle 102 as well as the line segments 103, 104, and 105. The shape is, however, not limited to the shape of the marker 120, and any other shape may be possible as far as the reference marker position and the reference marker angle can be identified.

The apparatus and method described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that is capable of sewing an embroidery pattern on a work cloth held by an embroidery frame, comprising:

a storage device that stores embroidery data to identify a shape of the embroidery pattern and reference line data to identify a pattern position and a reference pattern line, the pattern position being a position of a reference point of the embroidery pattern on the work cloth at which the embroidery pattern is to be sewn and the reference pattern line being a straight line indicating an angle with respect to a predetermined direction on the work cloth at which the embroidery pattern is to be sewn;

an imaging device that captures an image of the work cloth onto which a marker that can be affixed onto the work cloth is affixed;

a detection device that detects a marker position and a reference marker line based on information of the image captured by the imaging device, the marker position being a position of a reference point of the marker that is affixed onto the work cloth and the reference marker line being a straight line indicating an angle with respect to the predetermined direction on the work cloth at which the marker is affixed;

a conversion device that converts the embroidery data in such a manner that the pattern position coincides with the marker position and the reference pattern line coincides with the reference marker line; and a sewing control device that controls sewing of the embroidery pattern based on the embroidery data obtained after conversion by the conversion device.

2. The sewing machine according to claim 1, further comprising:

a determination device that determines whether the marker is positioned in an imaging region of which an image can be captured by the imaging device, based on the information of the image captured by the imaging device;

a transfer device that transfers the embroidery frame; and a transfer control device that controls transfer of the embroidery frame by the transfer device, wherein the transfer device controls the transfer of the embroidery frame by the transfer device to position the marker in the imaging region, if it has been determined by the determination device that the marker has not been positioned in the imaging region.

3. The sewing machine according to claim 1, further comprising a selection device that selects a part of an imaging region of the imaging device, wherein the detection device detects the marker position and the reference marker line based on a part of the information of the image captured by the imaging device corresponding to the part selected by the selection device.

4. The sewing machine according to claim 1, wherein the imaging device comprises a CMOS image sensor.

5. A non-transitory computer-readable medium storing a program to control a sewing machine that is capable of sewing an embroidery pattern on a work cloth held by an embroidery frame, the program causing a controller of the sewing machine to execute instructions of:

acquiring information of an image, captured by an imaging device, of the work cloth onto which a marker that can be affixed onto the work cloth is affixed;

detecting a marker position and a reference marker line based on the information of the captured image, the marker position being a position of a reference point of the marker that is affixed onto the work cloth and the reference marker line being a straight line indicating an angle with respect to a predetermined direction on the work cloth at which the marker is affixed;

converting predefined embroidery data to identify a predefined shape of the embroidery pattern, based on a pattern position and a reference pattern line contained in predefined reference line data to identify the pattern position and the reference pattern line, the pattern position being a position of a reference point of the embroidery pattern on the work cloth at which the embroidery pattern is to be sewn, and the reference pattern line being a straight line indicating an angle with respect to the predetermined direction on the work cloth at which the embroidery pattern is to be sewn, the embroidery data being converted in such a manner that the pattern position coincides with the marker position and the reference pattern line coincides with the reference marker line; and controlling sewing of the embroidery pattern based on the embroidery data obtained after conversion.

6. The non-transitory computer-readable medium according to claim 5, wherein the program causes the controller to execute further instructions of:

determining whether the marker is positioned in an imaging region of which the image can be captured by the imaging device, based on the information of the captured image; and controlling transfer of the embroidery frame by a transfer device to position the marker in the imaging region, if it has been determined that the marker has not been positioned in the imaging region.

7. The non-transitory computer-readable medium according to claim 5, wherein the program causes the controller to execute further instruction of selecting a part of an imaging region of the imaging device, wherein the instruction of detecting the marker position and the reference marker line instructs to detect the marker position and the reference marker line based on a part of the information of the image captured by the imaging device corresponding to the selected part.

* * * * *